US006402083B1

(12) United States Patent
Horn et al.

(10) Patent No.: US 6,402,083 B1
(45) Date of Patent: Jun. 11, 2002

(54) BOBBIN LOADING AND UNLOADING APPARATUS

(75) Inventors: Matthias Horn, Ahrensburg; Thorsten Schmidt, Schwarzenbek; Walter Kitzing, Pinneberg; Ulf Ernst, Hamburg, all of (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/417,314

(22) Filed: Oct. 13, 1999

(30) Foreign Application Priority Data

Oct. 13, 1998 (DE) ..... 198 47 160

(51) Int. Cl.[7] ..... B65H 67/04

(52) U.S. Cl. ..... 242/559.2; 242/560.1; 242/561

(58) Field of Search ..... 242/559, 559.1, 242/559.2, 559.3, 560, 560.1, 561

(56) References Cited

U.S. PATENT DOCUMENTS

| | | | | |
|---|---|---|---|---|
| 3,974,007 | A | | 8/1976 | Greve |
| 4,281,670 | A | | 8/1981 | Heitmann et al. |
| 4,798,349 | A | * | 1/1989 | Manservisi |
| 4,840,321 | A | * | 6/1989 | Focke et al. |
| 4,896,842 | A | * | 1/1990 | Heinz et al. |
| 4,953,805 | A | * | 9/1990 | Rauh |
| 5,031,381 | A | * | 7/1991 | Focke |
| 5,135,103 | A | * | 8/1992 | Focke et al. |
| 5,205,505 | A | * | 4/1993 | Focke et al. |
| 5,248,109 | A | * | 9/1993 | Berger et al. |
| 5,249,757 | A | * | 10/1993 | Draghetti et al. |
| 5,285,978 | A | * | 2/1994 | Sakano et al. |

FOREIGN PATENT DOCUMENTS

| | | |
|---|---|---|
| DE | 12 66 094 B | 8/1966 |
| DE | 37 40 806 A | 6/1989 |
| DE | 41 13 193 | 11/1991 |
| EP | 0 260 453 A | 3/1988 |
| EP | 0 269 807 A | 6/1988 |
| EP | 0 487 907 A | 6/1992 |
| EP | 0 539 983 A | 5/1993 |
| EP | 07 081810 | 3/1995 |
| EP | 0 820 944 | 1/1998 |
| EP | 10 139230 | 5/1998 |

* cited by examiner

*Primary Examiner*—William A. Rivera
(74) *Attorney, Agent, or Firm*—Venable; Robert Kinberg

(57) ABSTRACT

Apparatus for introducing fresh bobbins containing supplies of convoluted web material into and for evacuating expired bobbins from web consuming machines has a reservoir for a horizontal row of coaxial fresh bobbins and a conveyor system for delivery of selected fresh bobbins directly to one of several stub shafts on a turntable which is indexible about a horizontal axis parallel to the common axis of the fresh bobbins in the reservoir. The conveying system includes an elevator which is movable into the reservoir from below to engage and lift a selected fresh bobbin and to thereupon transport it directly onto the selected stub shaft. An expired bobbin, normally in the form of a hollow core, is engaged by a gripper which moves it off the respective stub shaft and into a magazine which is adjacent and parallel to the reservoir.

23 Claims, 16 Drawing Sheets

BOBBIN LOADING AND UNLOADING APPARATUS

BACKGROUND OF INVENTION

This invention relates to improvements in apparatus for loading bobbins or reels of convoluted web material into web consuming machines and for unloading expired or consumed bobbins from such machines. More particularly, the invention relates to improvements in apparatus for replacing expired rotary bobbins with fresh rotary bobbins containing supplies of convoluted flexible web or strip material. As a rule, or at least in many instances, an expired bobbin consists of a tubular core or shell which is ready to be discarded or to receive a fresh supply of convoluted paper or the like. Typical examples of web or strip material which is stored on the core or shell of a bobbin is cigarette paper, so-called tipping paper which is used in machines for making filter cigarettes or like products, metallic foil, plastic foil or other web-like materials which are utilized in the tobacco processing industry for the making of tubular wrappers for tobacco, filter material for tobacco smoke or both, for conversion into blanks which are ready to be draped around arrays of plain or filter cigarettes or the like, and for analogous purposes.

As a rule, a conventional fresh bobbin loading or replacing machine (e.g., in a cigarette rod or filter rod making machine, in a filter tipping machine or in a cigarette packing machine) comprises one or more supports or carriers for fresh and expiring bobbins, a reservoir for storage of at least one fresh bobbin at the loading station, a station for the storage of a supply of fresh bobbins, means for conveying fresh bobbins from a larger source or from a maker to the aforementioned station, means for conveying fresh reels at the station and to the reservoir, and means for delivering (when necessary) discrete fresh bobbins or reels from the reservoir to the carrier which supports a reel during withdrawal of web from the core of the expiring bobbin of course, it is equally necessary to withdraw the expired (spent) bobbins (i.e., the empty cores or spools) and to dispose of such remnants of fresh bobbins.

A drawback of the aforedescribed conventional bobbin loading (expired bobbin replacing) apparatus is that they occupy inordinately large amounts of space as well as that they comprise a large number of in part bulky, in part complex and/or in part expensive component parts. This holds particularly true for the various conveyor systems which must be provided to deliver loaded (fresh) bobbins relatively close to, thereupon nearer to and ultimately all the way to (onto) the devices (such as stub shafts or the like) which support the bobbins during withdrawal of web material therefrom.

An apparatus of the above outlined character is disclosed, for example, in European patent No. 0 820 944. The patent discloses a turntable which supports an expiring bobbin, a frame which supports a fresh bobbin behind the turntable, and endless belts or bands which are mounted on or in the frame and which serve to advance fresh bobbins along the frame and nearer to the rear side of the turntable. Additional conveyor means serve to take over filled bobbins from the aforementioned belts or bands and to advance such bobbins to the front side of the is turntable, namely into the range of bobbin-supporting means on the turntable.

Published German patent application Serial No. 41 13 193 discloses a different bobbin loading apparatus wherein the endless belts or bands are replaced with means for lifting loaded bobbins from a lower level to a higher level. A drawback of each of the aforedescribed conventional apparatus, especially of that disclosed in the aforementioned European patent, is that the combinations of various bobbin delivering, storing and additional transporting means contribute excessively or at least appreciably to the bulk, complexity and cost of a production line in a cigarette making and packaging plant. Moreover, such apparatus must be installed at locations where space is at a premium and wherein the elimination of malfunctions is likely or bound to involve prolonged interruptions in the operation of a production line and attendant enormous losses in output. Therefore, it is highly desirable that the operation of each unit or subassembly in such complex machinery be simplified as much as possible,

OBJECTS OF THE INVENTION

An object of the invention is to provide a simple, compact and relatively inexpensive apparatus for loading fresh rotary bobbins or reels and for evacuating expired bobbins in situations when an uninterrupted supply of paper strips or other web material is of importance for proper operation of a mass-producing machine or an entire production line.

Another object of the invention is to provide the apparatus with novel and improved means for delivering fresh bobbins to the web dispensing station or stations.

A further object of the invention is to provide the above outlined apparatus with a novel and improved arrangement for the evacuation of expired bobbins from the web feeding station.

An additional object of the invention is to provide a machine which employs one or more bobbin processing apparatus of the above outlined character.

Still another object of the invention is to provide a tobacco processing or a tobacco smoke filtering material processing machine which embodies one or more bobbin manipulating apparatus of the above outlined character.

A further object of the present invention is to provide the above outlined apparatus with novel and improved means for manipulating accumulations of fresh and/or expired bobbins or reels at the locale of use of web material.

Another object of the invention is to provide a novel and improved method of manipulating fresh and expired bobbins or reels at a location where fresh bobbins are compelled to dispense their supplies of convoluted web or strip material in the form of paper, metallic foil, plastic foil, coherent blanks for conversion into packets or the like.

An additional object of the invention is to provide a method of treating fresh bobbins gently and at a required frequency or speed to ensure the delivery of convoluted web or strip material to one or more consumers at a required rate and invariably in optimum condition for further processing.

Still another object of the invention is to provide a novel and improved combination of a reservoir for fresh bobbins and conveyor means for moving fresh bobbins or reels within as well as outside of the reservoir in a novel and improved manner.

A further object of the instant invention is to reduce the total of down times of mass-producing machines which must receive uninterrupted supplies of webs or strips of flexible material in the form of paper, metallic foil, plastic foil or the like.

Another object of the invention is to automatically regulate the distribution of filled and/or expired bobbins in the reservoir or reservoirs of a bobbin loading/unloading machine.

SUMMARY OF THE INVENTION

One feature of the present invention resides in the provision of an apparatus for replacing expired rotary bobbins with fresh rotary bobbins containing supplies of convoluted web material. The improved apparatus comprises a mobile carrier (such as a turntable which is indexible about a substantially horizontal axis) for expiring bobbins (i.e., for bobbins which are about to rotate or in the process of rotating to become expired bobbins as a result of withdrawal of the supplies of convoluted web material from their cores, normally in the form of hollow spools), a reservoir or storage facility for temporary storage of fresh bobbins, and means for conveying fresh bobbins from the reservoir directly to the carrier.

The turntable is provided with one or more supports (such as two stub shafts which are located diametrically opposite each other with reference to the axis with respect to which the turntable is indexible and which can be received in the hollow cores of bobbins to drive or to be driven by the bobbins).

In accordance with a presently preferred embodiment, the conveying means comprises an elevator which can raise or lower at least one selected fresh bobbin to any one of a plurality (e.g., an infinite number) of different levels with respect to the carrier to thus facilitate the transfer of a fresh bobbin onto the single support or onto one of two or more plural supports, and means for advancing the elevator toward and away from the carrier.

The reservoir preferably comprises means (e.g., in the form of two rails which are parallel and flank the axis of rotation of the carrier) for storing a plurality of coaxial bobbins The axis or axes of the fresh bobbin(s) in the reservoir is or are parallel to the axis or axes of the rotary carrier and/or its support or supports for fresh, expiring and expired bobbins.

The guide or guides of the reservoir is or are or can be at least substantially horizontal. In accordance with one presently preferred embodiment, the storing means for fresh bobbins comprises two parallel guide members (e.g., in the form of facetted horizontal rails) for outermost convolutions of convoluted web material on the stored coaxial bobbins, and the elevator of the conveying means is movable up and down between the guide members to lift selected fresh bobbins off the guide members. The turntable of the mobile carrier is indexible about an axis which is parallel to the guide members, and the conveying means of such apparatus further comprises means for transporting the elevator at a level such that the fresh bobbin or bobbins on the elevator is or are movable above and in parallelism with the guide members toward or away from the turntable. Such elevator is transportable to deliver at least one fresh bobbin from a given or desired or only remaining position in the reservoir directly onto a single support or onto one of several supports of the indexible carrier.

Regardless of whether the turntable carries one or more supports (such as one or more stub shafts), each support is preferably eccentric (i.e., its axis can be parallel to but need not coincide with the axis of the turntable), and the apparatus can further comprise means for releasably clamping the core of a fresh bobbin on the shaft or a shaft of the turntable.

The clamping means can comprise means for holding the core of a bobbin against movement axially of the shaft and away from the turntable.

If the reservoir comprises at least one elongated guide for fresh bobbins, the conveying means can comprise means for lifting a first fresh bobbin off any one of a plurality of selected portions of the at least one guide and for depositing a fresh bobbin on any one of a plurality of second selected portions of the at least one guide. The second selected portions include or can include a portion in which a fresh bobbin is maintained in a position of readiness for transfer directly onto the carrier. The position of readiness is or can be that position of the second plurality which is nearest to the carrier.

In order to automate the operation of the improved apparatus, the latter preferably further comprises one or more sensors and/or other signal generating means for monitoring the positions of fresh bobbins in the reservoir. The monitoring means is or can be arranged to share the movements of the conveying means, i.e., to share at least those movements of the elevator which take place in directions axially of the turntable toward and away from the support or supports. The signal generating means can comprise or control or cooperate with suitable means for arresting the conveying means in response to detection of a fresh bobbin in the reservoir. The arrangement can be such that the signals which are furnished by the monitoring means are utilized to effect the delivery of successive fresh bobbins from the reservoir to the carrier. The means for delivering can be arranged to deliver successive fresh bobbins to a predetermined position in the reservoir and, in the event that the predetermined position is then occupied, to a position immediately adjacent the predetermined position. If the latter (immediately adjacent) position is also occupied, the delivering means is caused or instructed to deliver fresh bobbins to another selected position, preferably a position nearest to the mobile carrier.

The improved apparatus preferably further comprises a novel and improved arrangement for manipulating hollow rotary cores which constitute expired bobbins. Such arrangement can comprise at least one magazine for cores (expired bobbins) and means for transferring cores from the mobile carrier to the magazine. The transferring means can comprise means for mechanically or otherwise (e.g., pneumatically) gripping cores during transfer from the carrier to the magazine.

The magazine of the improved arrangement for evacuation of expired bobbins can comprise an elongated trough which is arranged to confine expired bobbins in positions in which the expired bobbins are at least substantially coaxial with each other. The transferring means of such arrangement can comprise means for moving expired bobbins in the trough by way of the expired bobbin being transferred from the carrier into the trough.

The just described arrangement for disposing of expired bobbins (i.e., for removing expired bobbins from the mobile carrier) can be utilized with (e.g., incorporated into) the novel apparatus for replacing expired bobbins with fresh bobbins, or independently of such apparatus or any other known apparatus which is adapted to deliver fresh bobbins to one or more supports on an indexible turntable or another suitable carrier.

An important step of the novel method is that of transferring fresh bobbins (e.g., for convoluted webs of cigarette paper, tipping paper or wrapping material for arrays of plain or filter cigarettes or the like) from a reservoir directly to that part of the apparatus which supports an expiring bobbin, i.e., which supports the bobbin that is in the process of dispensing convoluted web or strip material into a web consuming or processing machine. Another important step of the improved method is that of moving a selected fresh bobbin in and from the reservoir in a plurality of directions, e.g., first upwardly to disengage the selected fresh bobbin from the component part or parts of the reservoir, and thereupon horizontally or substantially horizontally toward the mobile carrier, preferably directly into requisite engagement with the support (such as one of the aforediscussed stub shafts) which carries an expiring bobbin, namely a bobbin which is in the process of being relieved of the supply of convoluted web or strip on its core.

The novel features which are considered as characteristic of the invention are set forth in particular in the appended claims. The improved apparatus itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENT

Figure 1:
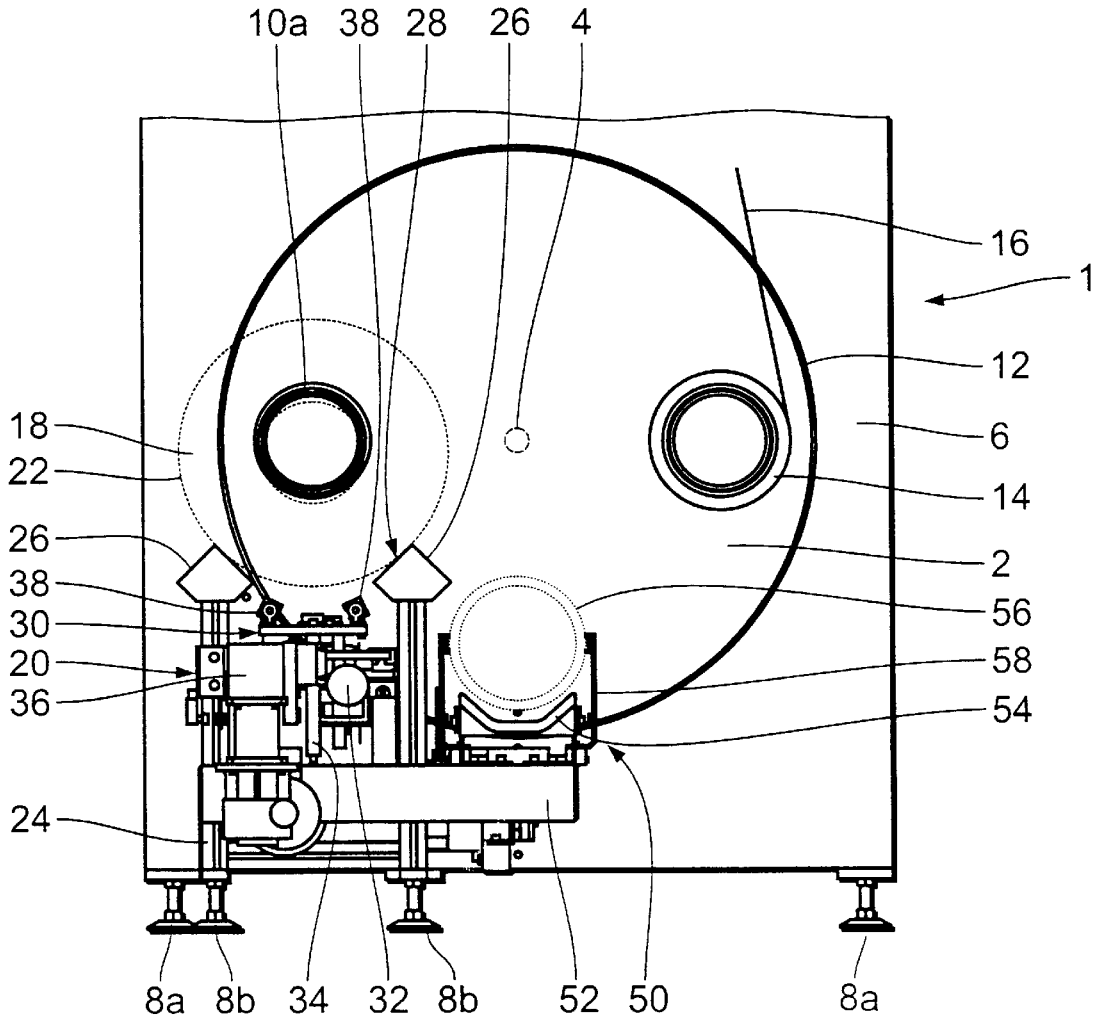
FIG. 1 is a front elevational view of an apparatus which embodies one form of the invention
Figure 2:
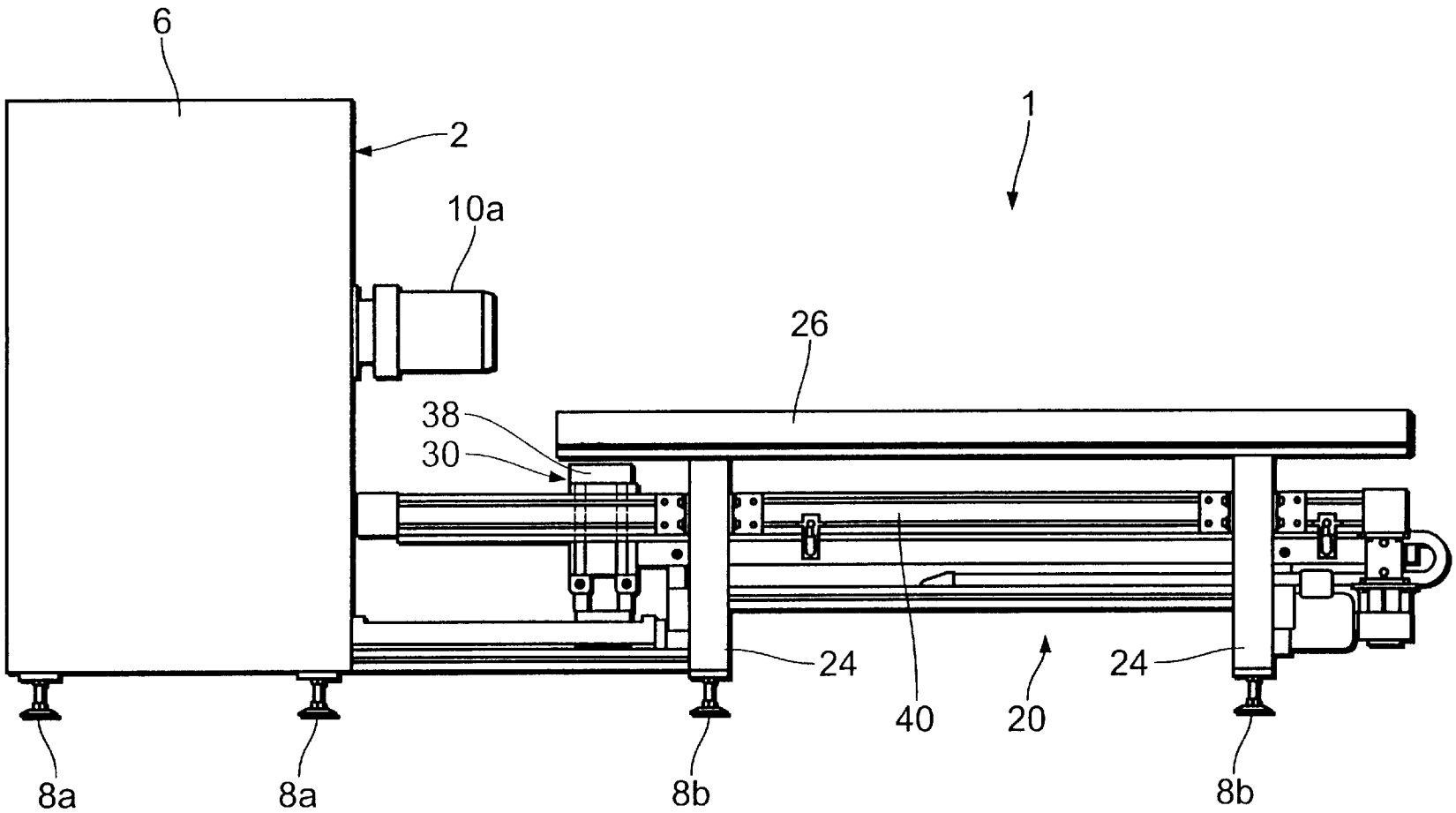
FIG. 2 is a side elevational view of the apparatus, with the bobbins omitted and with the elevator of the conveying means shown at a level beneath the guide means of the reservoir adjacent the turntable of the mobile carrier for expiring bobbins.

Referring first to FIGS. 1 and 2, there is shown an apparatus 1 which serves to replace expired rotary bobbins or cores 56 (one shown in FIG. 1 by dotted lines) with fresh rotary bobbins 18 (one indicated in FIG. 1 by dotted lines) Each fresh bobbin 18 contains a supply 22 of web or strip material 16 which is convoluted onto its core 56.

The apparatus 1 comprises a housing 6 mounted on floor-contacting legs 8*a* and supporting a mobile carrier or support 2 for fresh bobbins 18 and expiring bobbins 14. An expiring bobbin 14 is that bobbin which is in the process of paying out its web 16 of flexible material, e.g., into a cigarette packing machine wherein the leader of the web 16 is severed at regular intervals to yield a succession of blanks which are thereupon converted into boxes of cigarette packets, e.g., those known as hinged-lid packets each of which can contain a parallelepiped array of say twenty plain or filter cigarettes in the so-called quincunx formation. A packing machine which can employ the apparatus 1 is known as COMPAS and is distributed by the assignee of the present application.

The illustrated carrier 2 is a turntable which is indexible about a horizontal axis defined by a horizontal shaft 4 and is provided with two horizontal supports 10*a*, 10*b* disposed diametrically opposite each other with reference to the axis of the and each constituting a relatively short horizontal stub shaft. These stub shafts are sufficiently long (see FIG. 7) to enter the central opening of a core 56 and to adequately support an expiring bobbin 14 in a position in which the leader of the respective web 16 can be pulled into the packing machine where it is processed into discrete blanks in a manner not forming part of the present invention.

The supports 10*a*, 10*b* are rather closely adjacent the peripheral surface 12 of the turntable 2 so that each thereof can carry a fresh bobbin 18 including a large-diameter supply 22 of convoluted web material 16. The turntable 2 is held against rotation about the axis of the shaft 4 while the expiring bobbin 14 on one of its shafts 10*a*, 10*b* is in the process of paying out the web 16 into a packing machine or another consuming or processing machine. It is clear that the web 16 need not necessarily be drawn upwardly from the shaft 10*a* or 10*b* which supports the then expiring bobbin 14.

The left-hand shaft 10*a* of FIG. 1 is held in a position in which it is ready to accept and to support a fresh bobbin 18 which, when properly accepted, assumes the position shown in FIG. 1 by dotted lines. The bobbin 18 shown in FIG. 1 by dotted lines is actually held at a station 20 in front of the turntable 2 in a position corresponding to that of the leftmost fresh bobbin 18 shown in FIG. 3. At such time, the external surface of the outermost convolution of the supply 22 of web 16 on such fresh bobbin 18 rests on the suitably inclined surfaces 28 of two elongated guide members 26 forming part of a reservoir for a requisite supply of fresh bobbins 18 at the station 20. The guide members 26 of the illustrated reservoir are rails mounted on pairs of legs 24 provided with floor-contacting legs 8*b*.

The guide members 26 are parallel with the rotational axis of the turntable 2 and are mounted at opposite sides of and at a level below the shaft 4. The surfaces 28 of the members 26 make with each other an angle of approximately 90°; such surfaces can be flat or slightly concave, and their dimensions are preferably selected in such a way that the fresh bobbins 18 occupying the station 20 are compelled to assume positions in which they are coaxial with each other. This renders it possible to simplify the design of the means (including an elevator 30) for conveying fresh bobbins 18 from the station 20 (i.e., from the reservoir including the guide members 26) onto that shaft (10*a* or 10*b*) of the turntable 2 which is then in a position corresponding to that of the shaft 10*a* in FIG. 1.

The elevator 30 (e.g., a platform having a horizontal top surface) is movable up and down by a reversible feed screw 34 receiving rotary motion from a reversible electric motor 32 or another suitable prime mover and meshing with a nut at the underside of the elevator 30. Alternatively, the motor 32 can drive a reversible nut which meshes with a feed screw affixed to and extending downwardly from the elevator 30. All that counts is that the elevator 30 is movable up and down between the guide members 26 to thus lift a selected fresh bobbin off the surfaces 28 of the guide members 26 to a level which is required to ensure that a horizontal movement of the elevator 30 along the members 26 will result in transfer of the selected fresh bobbin 18 onto the shaft 10*a* or 10*b*.

The upper side of the elevator 30 carries two parallel elongated horizontal tracks 38 having pairs of mutually inclined top surfaces one of which engages the exposed surface 22 of the outermost convolution of the web 16 on the core 56 forming part of the respective fresh bobbin 18 from below, whereupon the elevator 30 is moved horizontally between and below the guide members 26 toward the exposed surface of the indexible turntable 2 in order to automatically slide the core 56 of the bobbin 18 on the elevator 30 onto the shaft 10*a* or 10*b*.

The means for moving the bobbin 18 on the elevator 30 horizontally toward and onto the shaft 10*a* or 10*b* comprises a linear drive 36, e.g., a feed screw which is rotatable by a reversible motor and mates with a pinion on the elevator 30 or a stationary toothed rack mating with a pinion which is rotatably mounted on the elevator and is adapted to be rotated by a reversible motor. Other types of means for advancing the elevator 30 along the guide members 26 can be utilized with equal or similar advantage.

While the drive 36 causes a full bobbin 18 to advance toward the turntable 2, such bobbin rests on the tracks 38 which form part of or are connected to the elevator 30 and maintain the exposed surface of the outermost convolution of the supply 22 of web 16 on such horizontal platform or elevator out of contact with the surfaces 28 of the guide members 26.

The mode of operation of the apparatus 1 is as follows:

Before the shaft 10*a* of the indexible turntable 2 assumes the nine o'clock position of FIG. 1, it assumes the six o'clock position of FIG. 1 in which it is relieved of the expired bobbin (shell 56) by an arrangement 50 including an elongated magazine 54 in the form of a shallow trough adapted to receive an entire row of coaxial expired bobbins or cores 56.

The entire arrangement 50 is or can be mounted on an arm 52 which is located at the station 20 and can be affixed to the reservoir including the guide members 26 and/or to the housing 6 for the turntable 2. The trough 54 of the arrangement 50 is installed at the outer side of the receptacle for the fresh bobbins 18, i.e., at the right-hand side of the right-hand guide member 26 shown in FIG. 1. FIGS. 10–13 show that the trough 54 can accommodate an entire row of coaxial expired bobbins 56 (empty cores) which are coaxial with each other.

A mobile engaging means or gripper 58 of the arrangement 50 serves to slip an empty core 56 off the adjacent stub shaft 10*a* or 10*b* and to slide it within and along the trough 54 whereby the empty core 56 which advances with the gripper 58 shifts the previously deposited empty cores 56 in front of it and toward the remote end of the trough 54, i.e., toward that end which is remote from the turntable.

Figure 11:
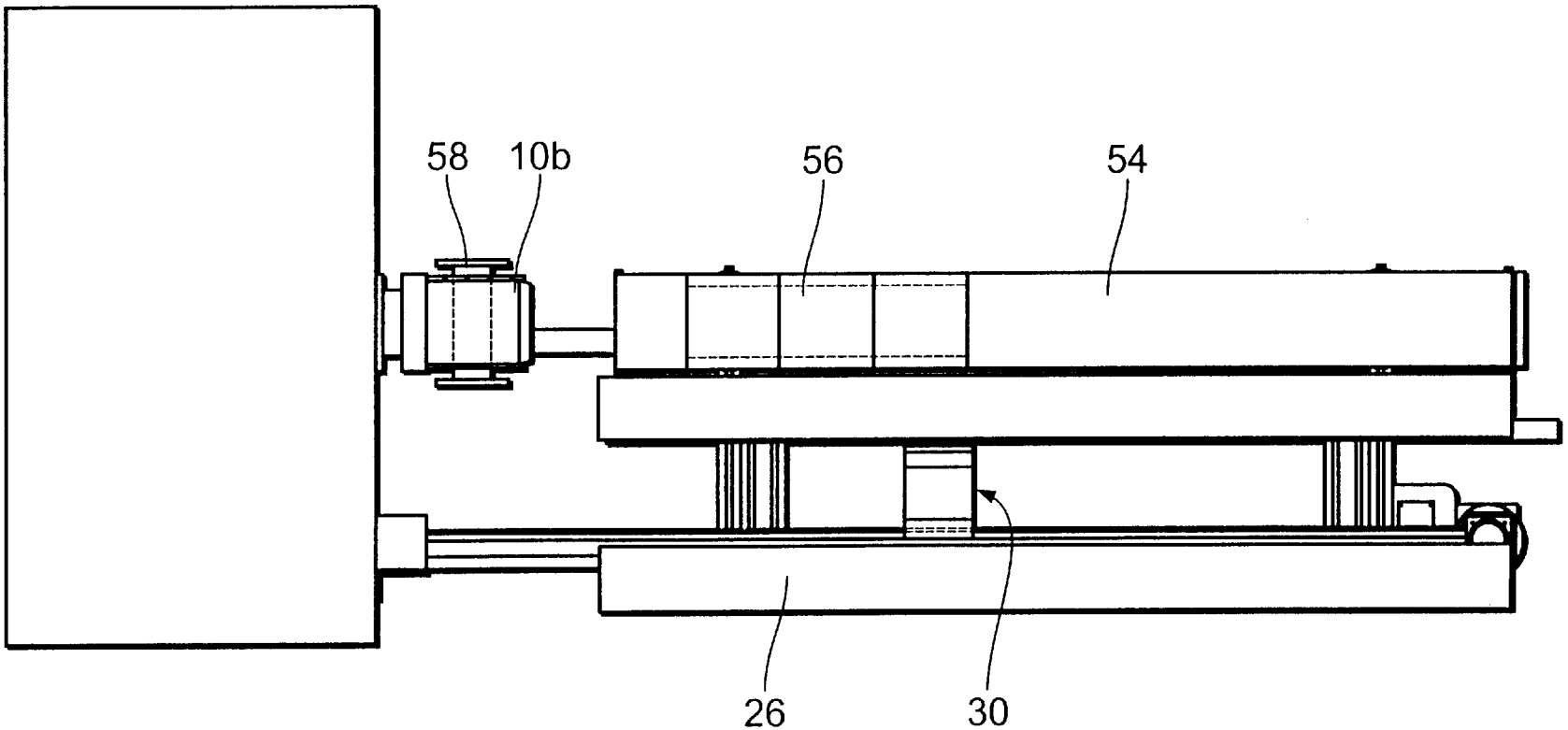
FIG. 11 illustrates the structure of FIG. 10 but with the parts of the arrangement for evacuation of expired bobbins in different positions.
Figure 12:
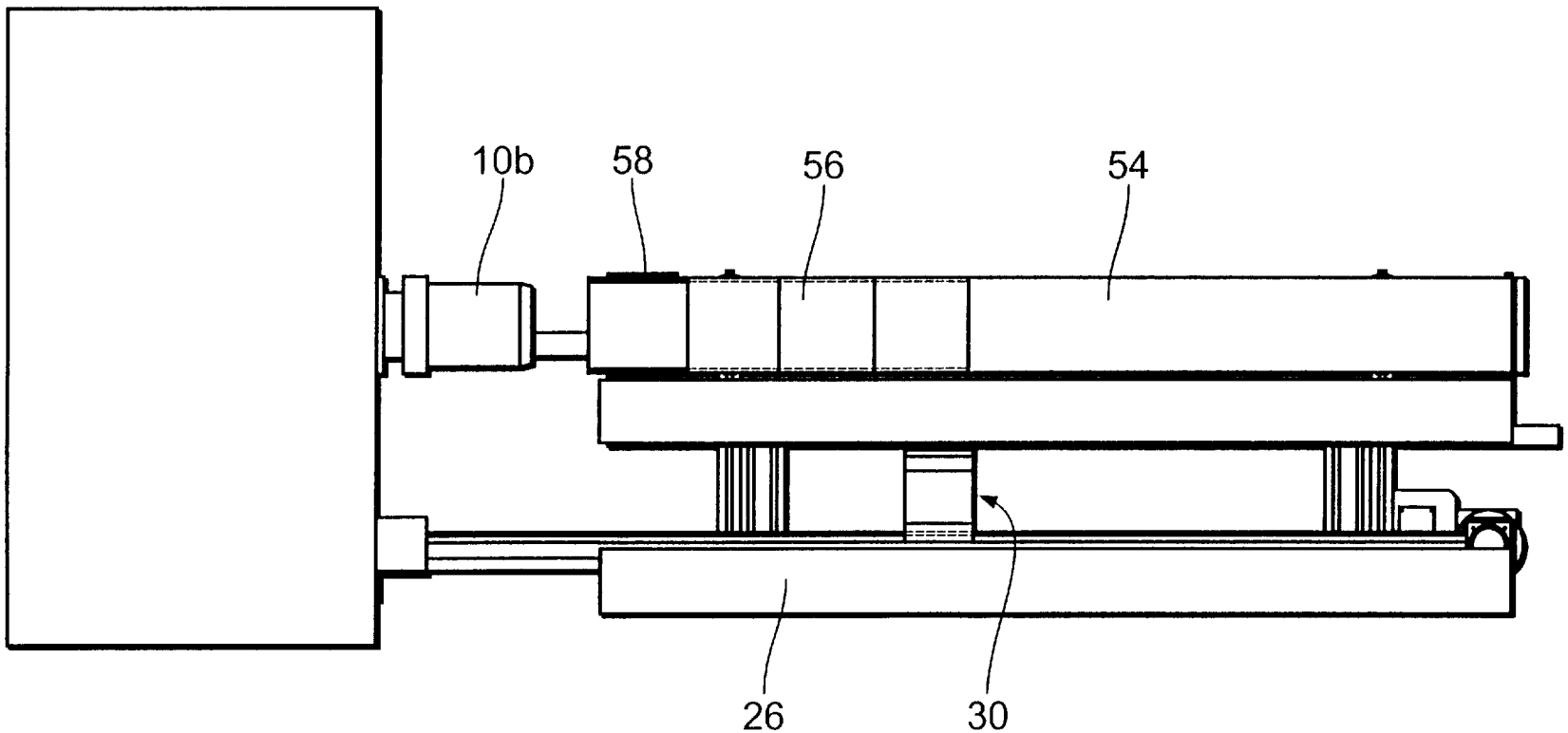
FIG. 12 shows the structure of FIGS. 10 and 11 but with the parts of the arrangement for evacuation of expired bobbins in different positions.
Figure 13:
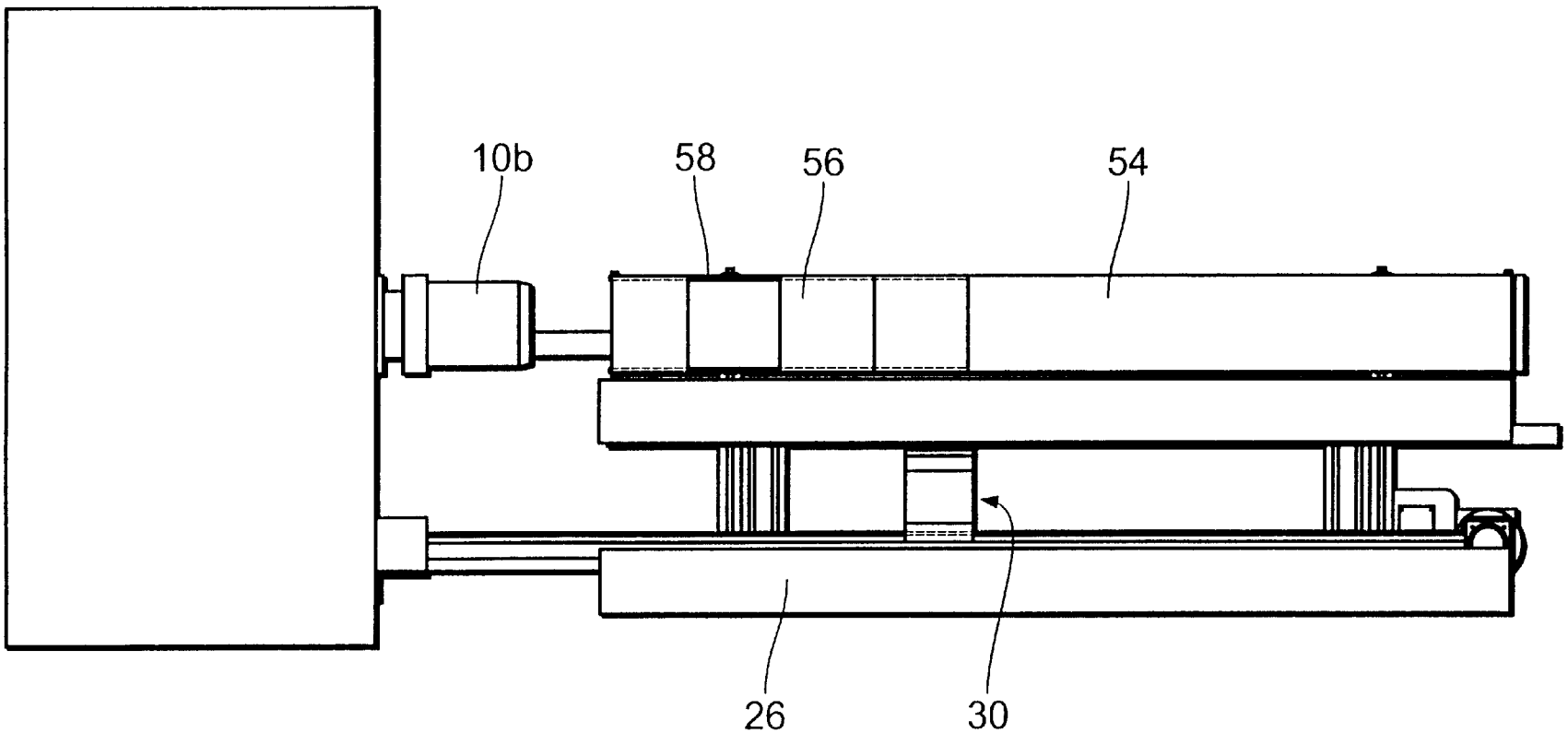
FIG. 13 shows the structure of FIG. 12 but with a device for shifting expired bobbins in their magazine at a different distance from the mobile carrier for expiring bobbins.

The turntable 2 is indexible in a clockwise direction, as viewed in FIG. 1. Thus, when the expiring web 14 at the three o'clock position of the turntable shown in FIG. 1 is converted into an expired bobbin (empty core 56), the controls of the apparatus 1 transmit a signal (such signal can be generated by a sensor which monitors the diameter of the expiring bobbin 14) to index the turntable 2 by 90° so that the freshly obtained expired bobbin 56 reaches the six o'clock position of FIG. 1 and comes to rest in the adjacent front portion of the trough 54. The gripper 58 is then set in motion to move the empty bobbin 56 off the shaft 10*b* and along the upper side of the trough 54. In other words, the entire horizontal file of empty bobbins or expired bobbins 56 is moved along the trough 54 and away from the front side of the turntable 2. FIG. 11 shows the gripper 58 in the process of engaging the expired bobbin 56 on the shaft 10*b*, and FIG. 12 shows the gripper 58 in the process of pushing such expired bobbin along the upper side of the trough 54.

It is also possible to modify the arrangement 50 in such a way that, when the turntable 2 of FIG. 1 is indexed through 90° from the three o'clock to the six o'clock position of FIG. 1, the freshly obtained expired bobbin 56 is located at a level somewhat above the trough 54. The gripper 58 is thereupon actuated to slip the expired bobbin 56 off the shaft 10*b* (at the six o'clock position) so that the bobbin 56 descends onto the trough 54 by gravity, and the gripper 58 is thereupon moved horizontally away from the front side of the turntable to push the entire row or file of expired bobbins 56 along the trough 54 and away from the turntable. The gripper 58 is thereupon ready to return toward the turntable to assume a position of readiness to slip the next expired bobbin of the shaft 10*a* upon clockwise indexing of the turntable through 180° and withdrawal of the web 16 from the expiring bobbin (14) then occupying the three o'clock position of FIG. 1.

Figure 9:
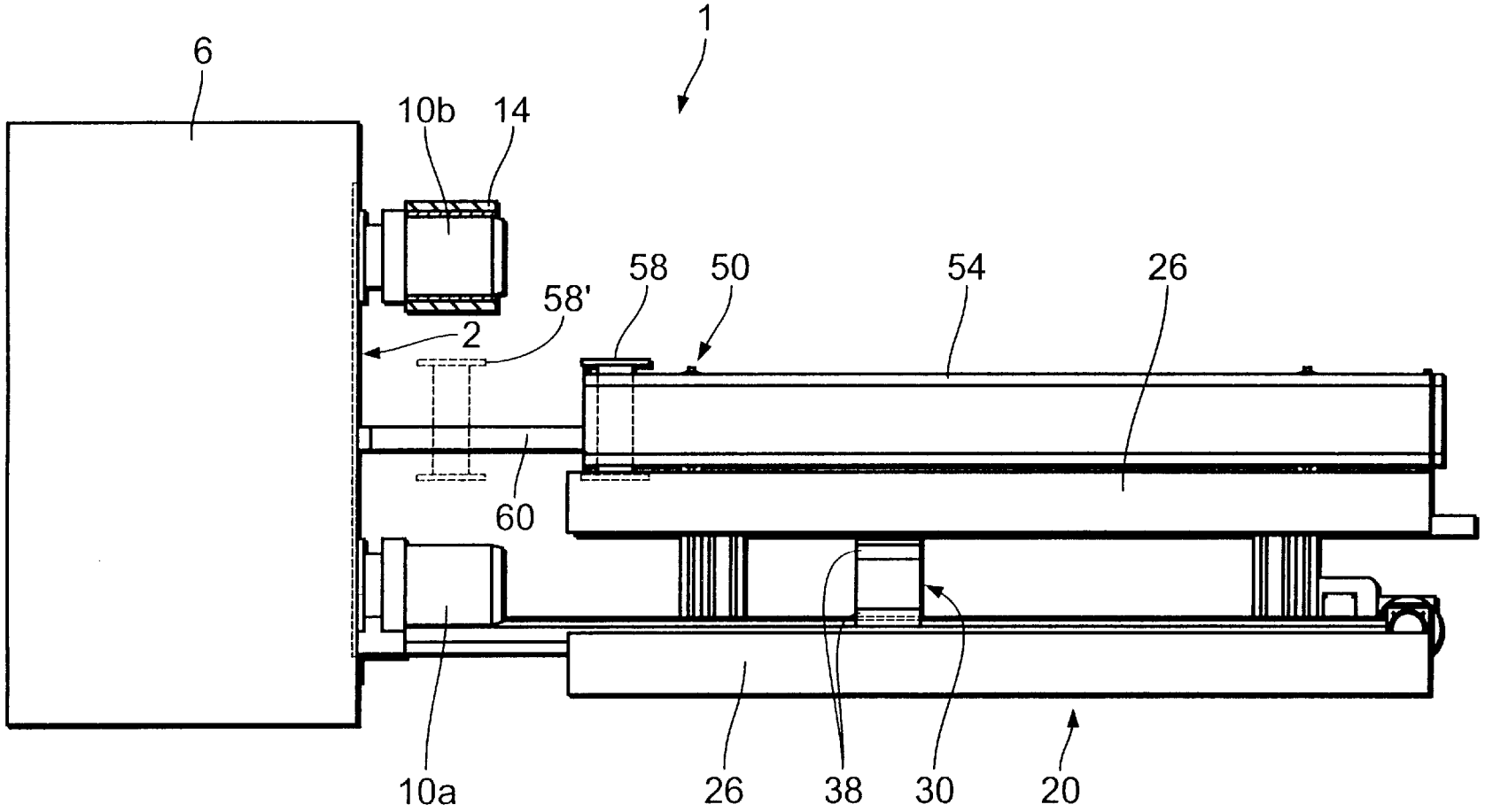
FIG. 9 shows the structure of FIG. 8 but with the turntable of the mobile carrier indexed through 90° relative to the angular position of FIG. 1 and with the upper support carrying an expired bobbin, the component parts of the arrangement for removal of expired bobbins being in positions assumed preparatory to removal of the expired reel.
Figure 10:
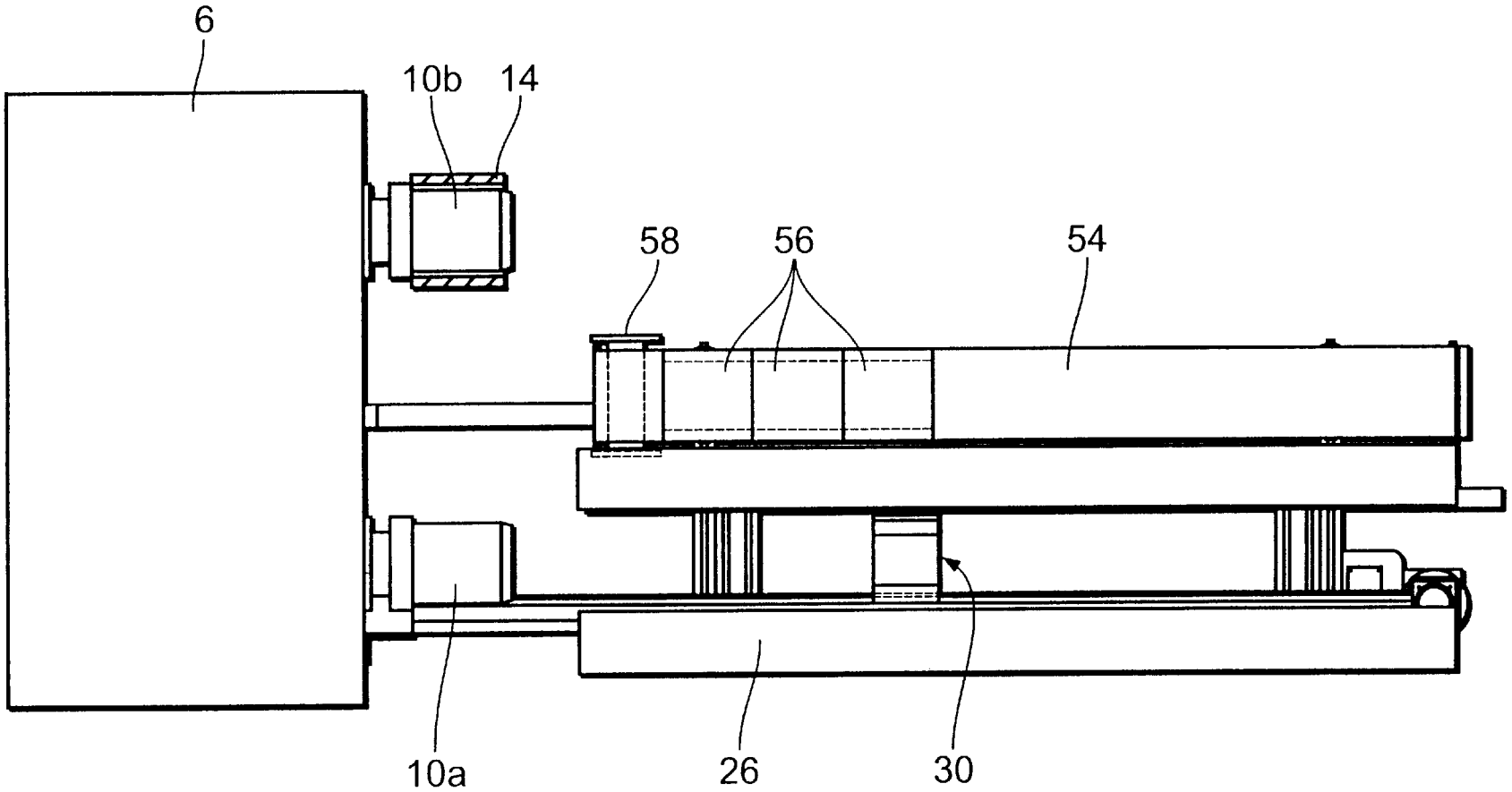
FIG. 10 shows the structure of FIG. 9 but subsequent to the transfer of several expired bobbins into the magazine of the arrangement for the evacuation of expired bobbins from a location adjacent the mobile carrier for expiring bobbins.

The reference character 60 denotes a horizontal guide rail for the gripper 58. The means for moving the gripper 58 along the guide 60 between the brokenline position 58' and the solid-line position of FIG. 9 is not shown in the drawings; such moving means can comprise a double-acting fluid-operated motor, an electric motor or the like. The gripper 58 assumes the position 58' of FIG. 9 when it is ready to accept a core 56 subsequent to indexing of such core from the three o'clock to the six o'clock position of FIG. 10 once the core 56 has been removed from the shaft 10*b* (i.e., once the gripper 58 has completed its axial movement from the broken-line position 58' to the solid-line position of FIG. 9), the turntable 2 is again indexed through 90° to thus move the shaft 10*b* to the nine o'clock position of FIG. 1 so that the shaft 10*b* is ready to accept a fresh bobbin 18 from the reservoir including the guide members 26. At such time, the fresh bobbin 18 of FIG. 1 is located at the three o'clock position of FIG. 1 and is ready to pay out its web 16 to the consuming or processing machine.

FIG. 9 further shows that the guide rail 60 for the gripper 58 is parallel with the guide members 26 for fresh bobbins 18 and that the elevator 30 is ready to advance toward the (by then emptied) shaft 10*b* in order to deliver a fresh bobbin 18 which is thereupon indexed with the turntable (twice through 90°) before it reaches the position occupied in FIG. 1 by the expiring bobbin 14. The same procedure is thereupon repeated at required intervals (depending upon the rate at which the processing machine consumes web material 16) and for a required period of time (e.g., during an entire shift).

FIG. 2 shows that the linear guide 40 for the elevator 30 extends close to the front side of the turntable 2 so that the elevator can deliver a fresh bobbin 18 all the way to the axial position in which the stub shaft 10*a* or 10*b* is properly received in the central opening of the core 56 forming part of such fresh bobbin. That position of the elevator 30 which is shown in FIG. 2 can be said to constitute a predetermined position or a position of readiness; the elevator 30 is then adjacent to and is located at a level beneath the left-hand end portions of the guide members 26, i.e., beneath those end portions of the guide members which are nearest to the turntable 2. The elevator 30 is assured to be stationary in its lower end position, i.e., at a level such that its web-contacting or web-engaging members 38 would be out of contact with the web 16 on the core 56 of a fresh bobbin 18 then located above the elevator 30 when the latter occupies the predetermined position of FIG. 2.

Figure 3:
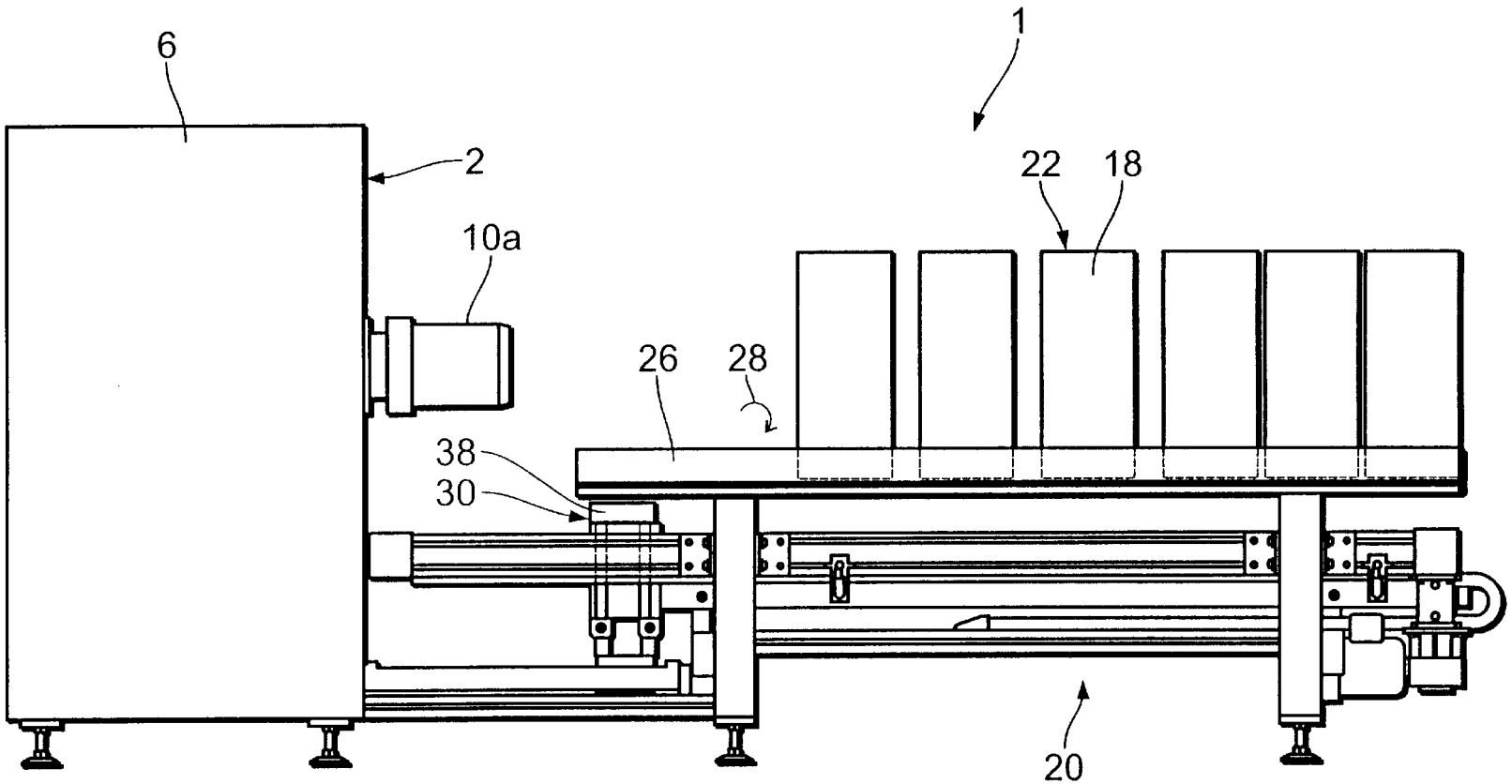
FIG. 3 shows the structure of FIG. 2 and a series of fresh bobbins in the reservoir.

FIG. 3 shows the elevator 30 in the predetermined position (the same as in FIG. 2) but the guide members 26 of the reservoir contain a number of randomly distributed (in part abutting and in part spaced-apart) fresh bobbins 18, The external surfaces of the outermost convolutions of the supplies 22 of web material 16 forming part of the fresh bobbins 18 shown in FIG. 3 rest on the suitably inclined surfaces 28 of the guide members 26. The members 38 of the elevator 30 are located beneath the surfaces 28, i.e., they would be out of contact with the leftmost fresh bobbin 18 of FIG. 3 even if such bobbin were located directly above the elevator 30.

The elevator 30 carries or otherwise shares the movements of a suitable sensor 42 serving as a means for monitoring the position of the nearest fresh bobbin 18. When the elevator 30 is caused to move from the predetermined position of FIG. 3 in a direction to the right (i.e., away from the turntable 2), the sensor 42 detects the nearest fresh bobbin 18 on the guide members 26 and generates a signal which is utilized by the controls to arrest the motor 32 when the elevator 30 is located exactly beneath the leftmost bobbin 5.

For example, the sensor 42 can be installed at that side of the elevator 30 which faces away from the turntable 2 to generate a signal when it detects the presence of a fresh bobbin 18 above it. The intensity and/or other characteristics of the signal change when the sensor 42 is advanced to the right of and beyond the leftmost fresh bobbin 18 of FIG. 4 so that the motor 32 is brought to a halt by the suitably programmed controls for the mobile components of the apparatus 1 when the elevator 30 is located in an optimum position for lifting and entrainment of the fresh bobbin 18 above it.

Alternatively, the sensor 42 can be installed at that side of the elevator 30 which confronts the turntable 2. When moved (by the motor 32) from the predetermined position of FIG. 3 and away from the turntable, the elevator comes to a halt when the sensor 42 generates a signal in response to detection of the leftmost fresh bobbin 18 of FIG. 4. The controls of the apparatus 1 thereupon cause the motor 32 to move the elevator 30 in the opposite direction (toward the turntable) until the sensor 42 transmits a signal denoting that the sensor is located to the left of the leftmost filled bobbin 18 of FIG. 4. This ensures that the elevator 30 is then located in an optimum position relative to the leftmost fresh bobbin 18 of FIG. 4. The extent to which the motor 32 returns the elevator 30 in a direction toward the turntable 2 can correspond to the respective dimension of the sensor 42 (as measured in the longitudinal direction of the guide members 26).

The sensor 42 can constitute or include a photosensitive detector which emits a beam of radiation adapted to be reflected or to be no longer obstructed in certain positions of the sensor 42 and the elevator 30.

Figure 4:
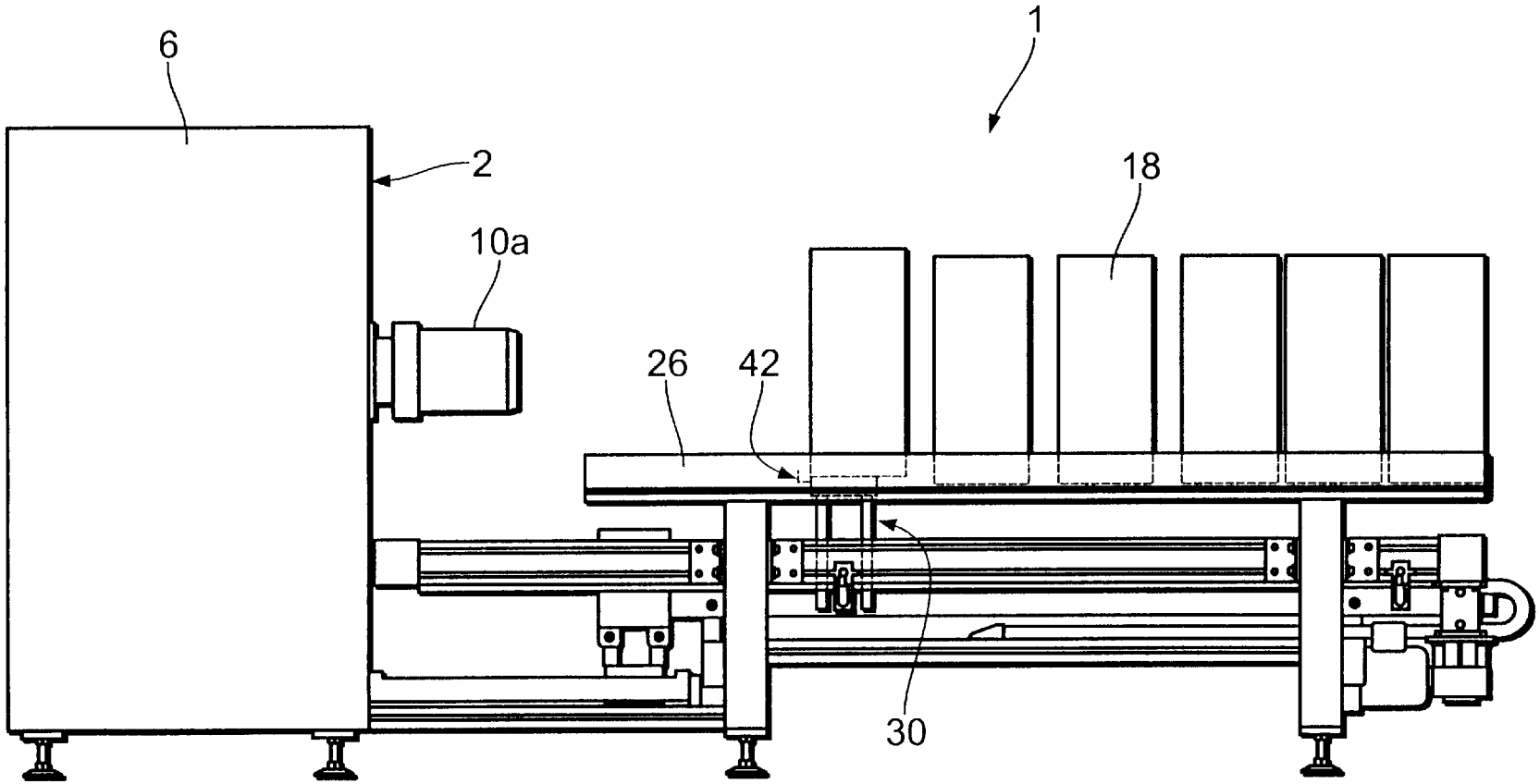
FIG. 4 shows the structure of FIG. 3 but with the elevator located at a level beneath the leftmost filled bobbin in the reservoir for temporary storage of filled bobbins.

The control system thereupon causes the elevator 30 to lift the tracks 38 so that such tracks cause the fresh bobbin 18 then located above the elevator to rise above the guide members 26 (see FIG. 4). The next step involves a movement of the raised elevator 30 along the guide 60 and toward the exposed side of the turntable (see FIGS. 5 and 6). This causes the stub shaft 10*a* to enter the central opening of the core 56 forming part of the fresh bobbin 18 on the tracks 38 of the elevator 30.

Figure 5:
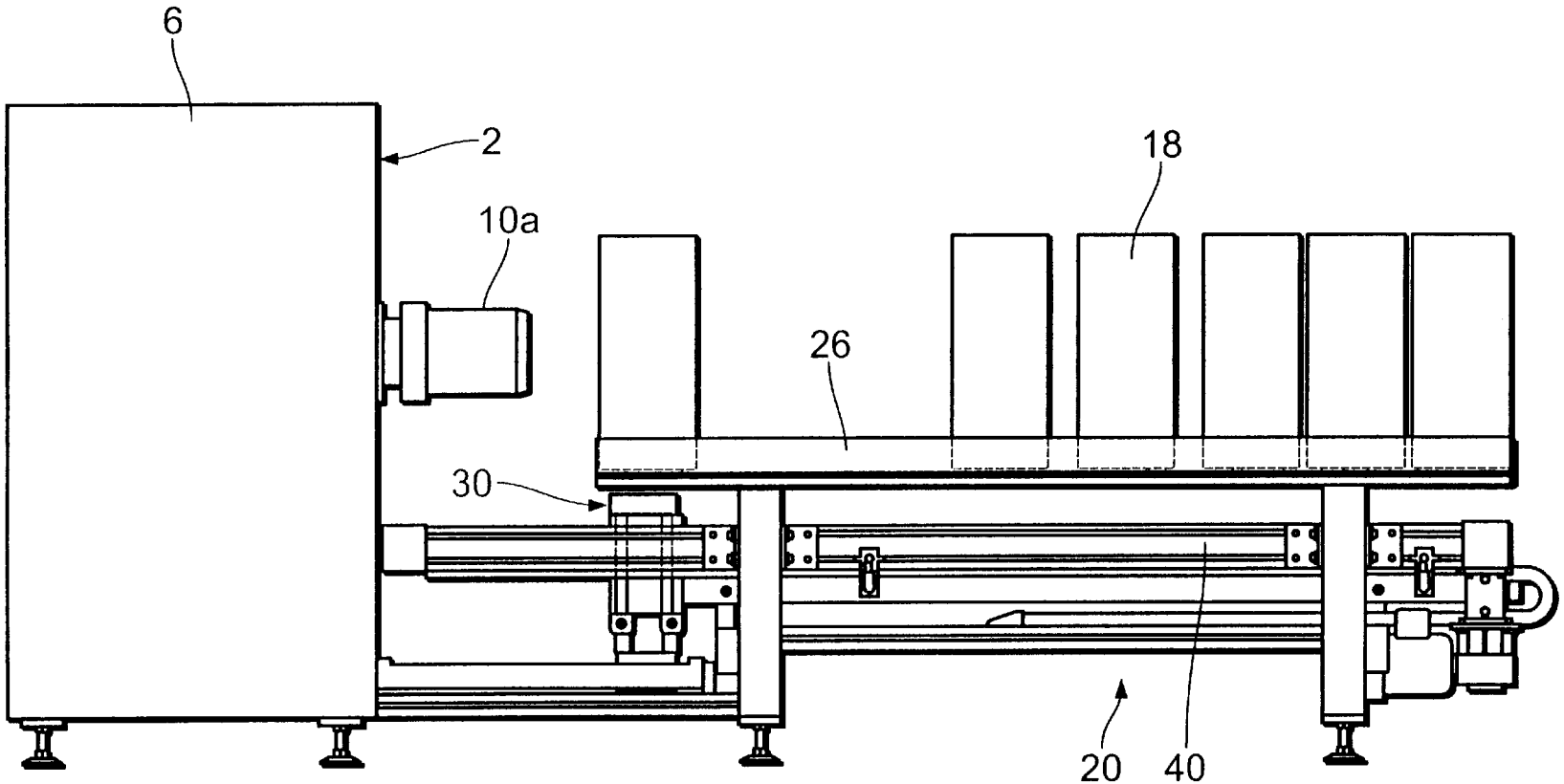
FIG. 5 illustrates the structure of FIG. 4 but with the elevator and the fresh bobbin on top of the elevator moved nearer to the mobile carrier for expiring bobbins.

If the turntable 2 need not receive a fresh bobbin 18, the movement of the raised elevator 30 from the position of FIG. 4 toward the turntable can be interrupted when the elevator reaches the predetermined position of FIG. 5. For example, such interruption of movement of the elevator 30 to and beyond the position of FIG. 6 can take place in the event of a malfunction of the web consuming machine and/or of the apparatus 1. If (or once) the elevator 30 has completed its movement toward the turntable 2 so that the thus delivered fresh bobbin 18 assumes the position of FIG. 7, the fresh bobbin can be locked to the shaft 10*a* against axial movement away from the turntable 2 in any well known manner, not shown. Such locking action can be initiated by the control system of the apparatus 1. For example, each of the shafts 10*a*, 10*b* can be provided with suitable clamping or gripping or holding means which is active as long as the shaft 10*a* or 10*b* remains in a position (such as the nine o'clock position of FIG. 1) in which the bobbin (14 or 18) thereon is ready to pay out web material 16.

Figure 6:
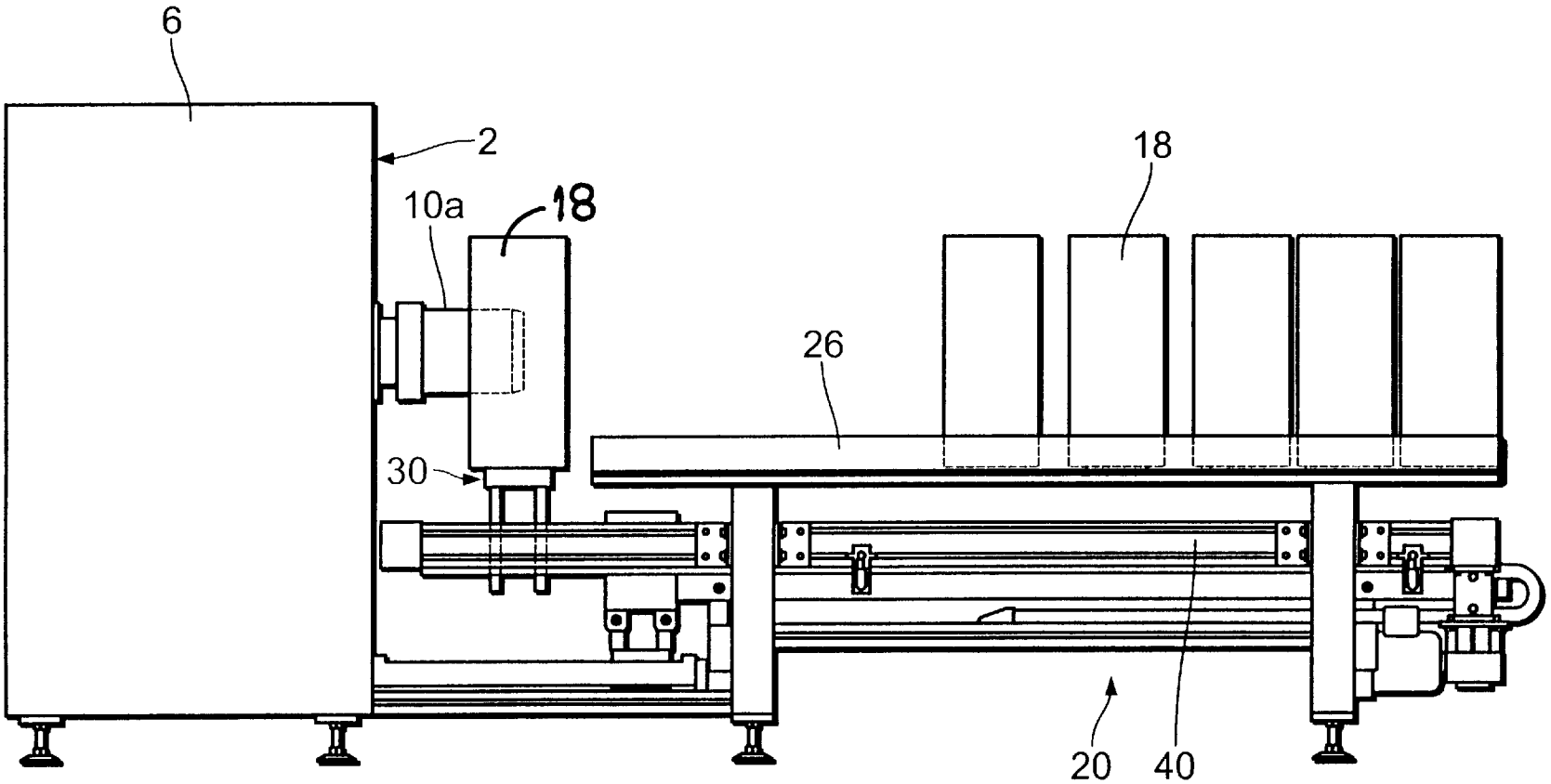
FIG. 6 shows the structure of FIG. 5 but with the leftmost filled bobbin in the process of being separably secured to one of the two supports forming part of the mobile carrier for expiring bobbins.

FIG. 6 shows the elevator 30 during actual transfer of a fresh bobbin 18 onto the shaft 10*a*. The elevator maintains the fresh bobbin 18 at such level that the axis of the bobbin coincides with the axis of the shaft 10*a*. Once the elevator 30 reaches the position of FIG. 7, i.e., a position nearest to the turntable 2, the shaft 10*a* is fully received in the core 56 of the fresh bobbin 18 and the elevator can descend to its lower level so that the tracks 38 do not interfere with a return movement of the elevator in a direction away from the turntable, for example, all the way to the position of FIG. 7 in which the elevator is ready to lift the leftmost fresh bobbin 18 off the guide members 26 of the reservoir at the station 20. The next step can involve a movement of the raised elevator 30 and of the fresh bobbin 18 above it to the predetermined position of FIG. 5 where the elevator remains until the control system receives a signal indicating that the fresh bobbin 18 above the elevator occupying the predetermined position should be transferred onto and releasably locked to the shaft 10*a* or 10*b*.

Figure 7:
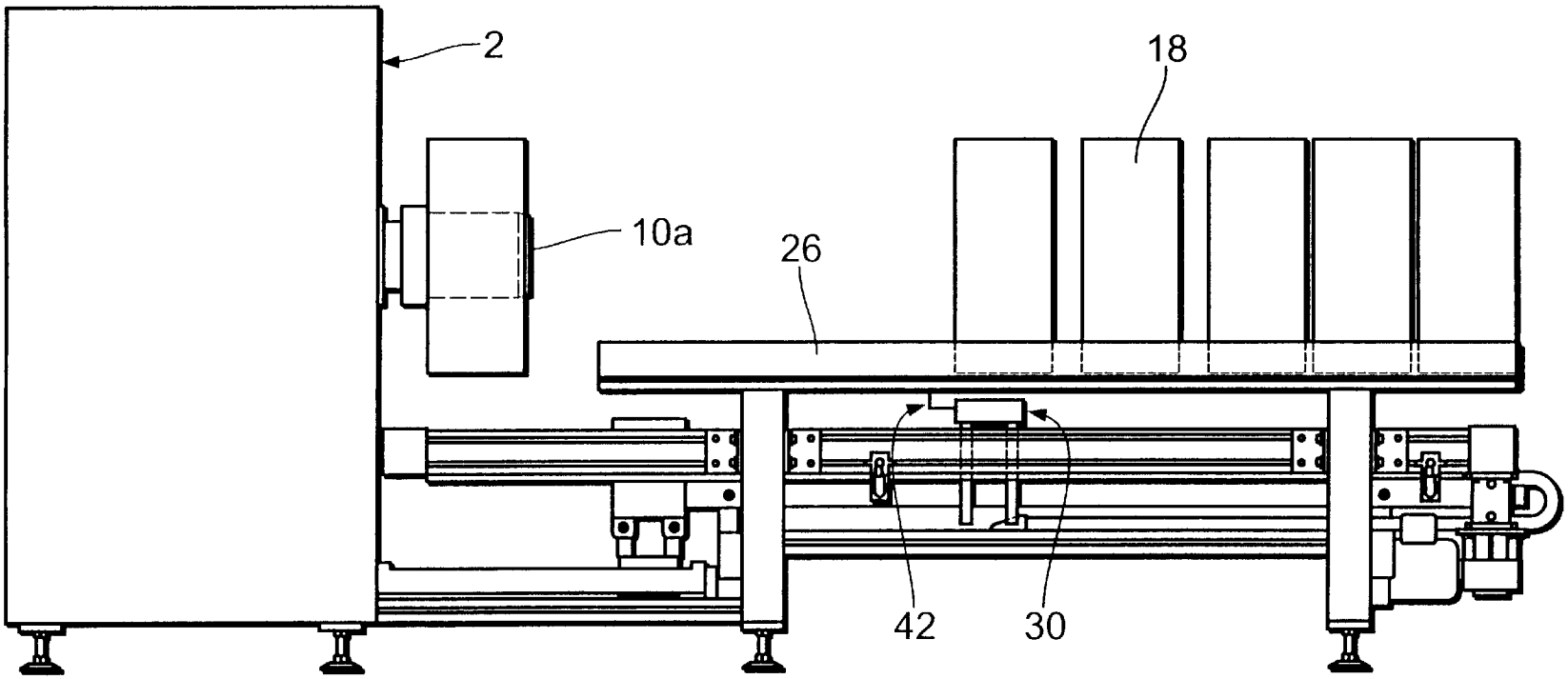
FIG. 7 illustrates the structure of FIG. 6 but with the leftmost filled bobbin fully mounted on its support and with the elevator transferred to a position beneath the leftmost filled bobbin in the reservoir.

The apparatus 1 can be programmed so that the step immediately following the step or steps shown in FIG. 6 takes place to ensure that the fresh bobbin 18 shown in FIG. 6 as being only partially transferred onto the shaft 10*a* is moved all the way to the axial position of FIG. 7 and the elevator 30 descends away from contact with the fresh bobbin on the shaft 10*a* and moves away from the turntable all the way to the position of FIG. 7, i.e. , to a position beneath the next leftmost fresh bobbin 18. The elevator 30 comes to a halt in the position of FIG. 7 in response to a signal (or to a series of signals) from the sensor 42 to the control system of the apparatus 1.

The shifting of the elevator 30 from the position of FIG. 5 or 6 back and all the way to the position shown in FIG. 7 can also (or additionally) serve an additional purpose, namely to provide room for the deposition of one or more fresh bobbins 18 onto the guide members 26 (e.g., between the shaft 10*a* and the leftmost fresh bobbin 18 on the guide members 26; namely onto the exposed portions of the guide members 26 shown in FIGS. 5 and 6), or to avoid a collision between the fresh bobbins 18 on the guide rails 26. For example, a worker might have placed a fresh bobbin 18 onto the guide members 26 adjacent the fresh bobbin 18 which is shown as being at least partially supported by the shaft 10*a* in FIG. 6 and as being supported only by the shaft 10*a* in FIG. 7. The lowered elevator 30 was free to bypass such freshly deposited bobbin 18 on its way from the position of FIG. 6, even nearer to the turnable 2, and thereupon to the position shown in FIG. 7. Such situation is shown in FIG. 8.

Figure 8:
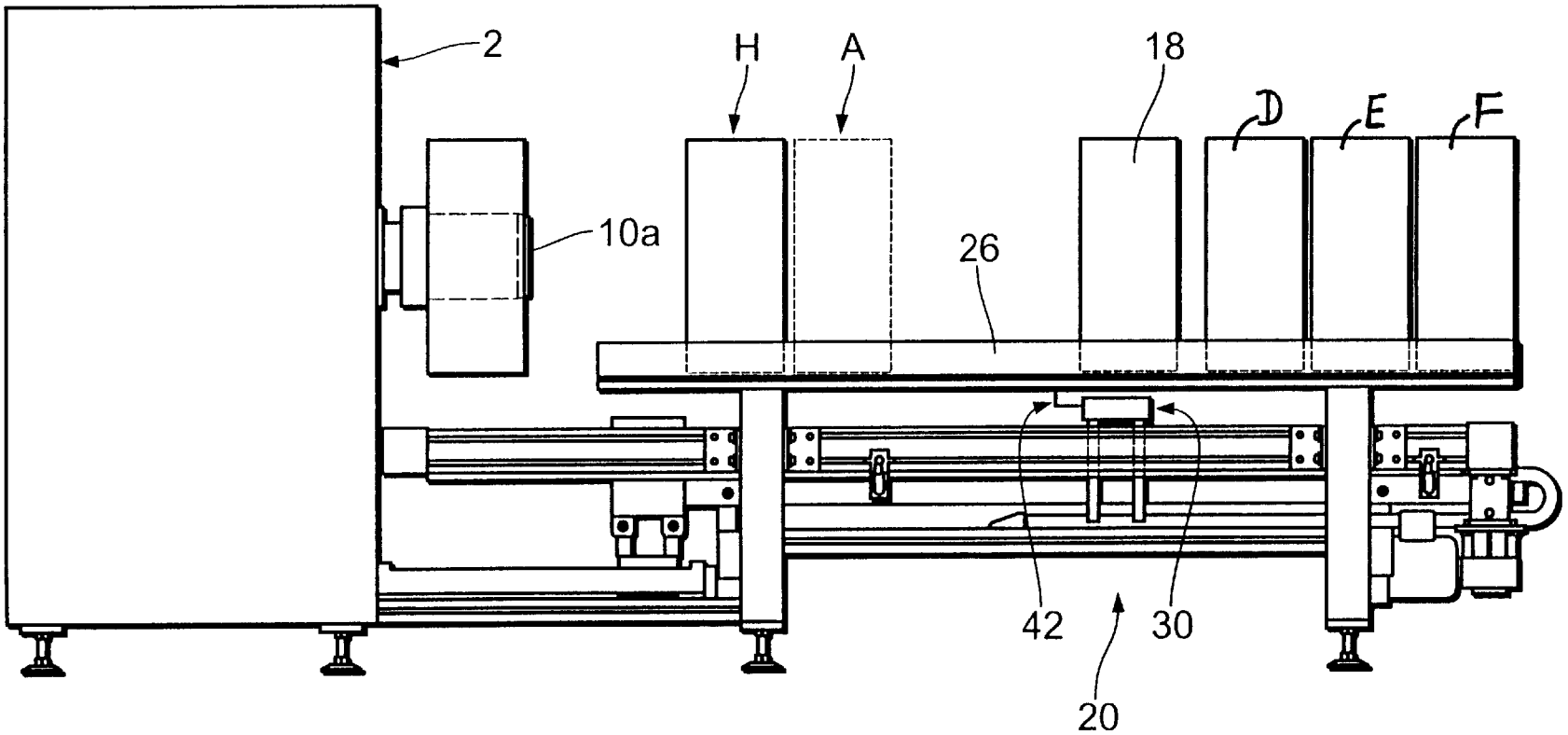
FIG. 8 shows the structure of FIG. 7 but with the elevator in the process of transferring successive filled bobbins toward positions nearer to the mobile carrier for expiring bobbins.

Let it be assumed that the elevator 30 has completed the transfer of the leftmost bobbin 18 on the guide members 26 of FIG. 7 to the position H shown in FIG. 8, namely to a predetermined position nearest to the turntable 2. Thereafter, a workman has deposited a fresh bobbin 18 to a position A (FIG. 8) nearest to the turntable after the bobbin H. In the meantime, the elevator 30 is free to descend, to bypass the bobbin H and/or the bobbin A from below, and to move to the position of FIG. 8, namely beneath the bobbin 18 on the guide members 26 nearest to the bobbin A. Such bobbin 18 (above the elevator 30 shown in the right-hand portion of FIG. 8) can be moved toward the turntable 2 without risking a collision with the bobbin A because the sensor 42 arrests the elevator 30 as soon as it advances to a position sufficiently close to the bobbin H (e.g., beneath the bobbin H) The elevator 30 can thereupon proceed to transfer the fresh bobbins D, E and F seriatim from the positions shown in FIG. 8 to the positions nearer or nearest to the turntable 2.

The situation is analogous if the elevator 30 is in the process of advancing the fresh bobbin A toward the turntable 2 while a worker deposits the fresh bobbin onto the guide members 26 of FIG. 8 in front of the oncoming bobbin. A The sensor 42 then detects the presence of the bobbin H in front of the oncoming bobbin A and brings the elevator 30 to a halt not later than when the bobbin A reaches the position of FIG. 8.

An important advantage of the improved apparatus 1 is that a fresh bobbin 18 which the elevator 30 picks up at the station 20 (i.e., in the reservoir including the guide members 26) need not be released until it reaches its ultimate position on the shaft 10*a* or 10*b* at the front side of the turntable 2. It is assumed here that the purpose of picking up a fresh bobbin 18 by the elevator 30 somewhere, at the station 20 was to deliver such fresh bobbin to the turntable 2 rather than to merely shift the fresh bobbins in the reservoir back and forth as described hereinbefore in connection with fresh bobbins including those shown at 18, A, D, E, F and H in FIG. 8.

Thus, it is no longer necessary to transfer fresh bobbins from one conveying means onto one or more additional conveying means because the elevator 30, in conjunction with the means 32–34 and 36 for respectively raising-lowering and reciprocating the elevator suffices to deliver fresh bobbins 18 seriatim from the station 20 onto the shaft 10*a* or 10*b*. This brings about unexpected savings in space, materials initial as well as maintenance cost. Furthermore, the surprisingly simple apparatus 1 is much less prone to malfunction than conventional apparatus and the improved apparatus can treat the fresh bobbins as well as the web material 16 gently for a number of important reasons. Thus, the accumulation or arraying of fresh bobbins 18 in the reservoir including the guide members 26 is highly predictable because such fresh bobbins are compelled to gather into a row of coaxial bobbins and also because the suitably inclined surfaces 28 of the guide members 26 are highly unlikely to damage or deface the outermost convolutions of web material 16 which come into actual contact with the surfaces 28. The same holds true for the likelihood of damage to the outermost convolution of web material 16 which is being contacted by the tracks 38 forming part of the elevator 30 and serving to actually raise the fresh bobbins 18 above and away from the surfaces 28 of the guide members 26 preparatory to and during transport of discrete fresh bobbins at the station 20 as well as from the station 20 onto the shaft 10*a* or 10*b*.

Another important advantage of the improved apparatus 1 is that the station 20 is located directly in front of the exposed side of the turntable 2. This ensures that a fresh bobbin which is to be delivered is onto the shaft 10*a* or 10*b* need not be transported along a circuitous path. Thus, the only time a bobbin 18 departs from a straight linear path extending in parallelism with the axis of the shaft 4 is when the elevator 30 is caused to move up or down. In addition, the up-and-down movements of the elevator 30 and of the fresh bobbin 18 thereon are very limited so that such movements under the action of gravity and/or as induced by the motor 32 and feed screw 34 are highly unlikely to exert an adverse influence upon the movements of the fresh bobbins 18 toward and onto the shafts 10*a* and 10*b*. The fact that the elevator 30 need not be moved sideways also contributes to pronounced reliability of guidance of a fresh bobbin 18 which has come into the range of the elevator for the purpose of being advanced to the leftmost position of FIG. 5 (i.e. , as near to the turntable 2 as possible) or directly from the station 20 onto one of the shafts 10*a*, 10*b*.

A presently preferred highly desirable and advantageous feature of the improved apparatus 1 is that the elevator 30 need not carry out any angular, helical and/or other movements along one or more arcuate paths. This not only simplifies the mounting of the elevator 30 but also ensures that the means for confining the elevator to its simple linear (up-and-down and/or reciprocatory) movements can stand long periods of use. Thus, all that is actually necessary is to lift a selected fresh bobbin IS off the guide members 26, to advance the thus raised fresh bobbin toward and beyond the front end portions of the guide members 26 preparatory to moving the fresh bobbin downwardly, forwardly and upwardly to a position of exact axial alignment of the central opening 70 (FIG. 16) of its core 56 with the shaft 10*a* or 10*b*. This is followed by an axial movement of the fresh bobbin all the way to the position shown in the left-hand portion of FIG. 7F.

FIG. 1 shows that the turntable 2 is located between the guide members 26 of the reservoir for fresh bobbins 18. This contributes to compactness of the apparatus 1 and ensures that the surfaces of the tracks 38 (which share the movements of the elevator and actually contact a lifted bobbin 18) are less likely to become contaminated. Furthermore, such mounting of the elevator 30 and its tracks 38 enables the elevator to rapidly reach any selected fresh bobbin 18 on the guide members 26 of the reservoir for fresh bobbins 18. This holds true irrespective of whether the elevator 30 is to serve as a means for shunting the fresh bobbins 18 at the station 20 or as a means for delivering fresh bobbins onto the shafts 10*a* and 10*b*. It will be seen that, quite surprisingly, the placing of the elevator 30 between and at a level below the guide members 26 contributes significantly to the versatility and flexibility of the entire apparatus. Moreover, the simplicity of the paths for the elevator 30 and the versatility of the elevator render it possible to employ rather simple, compact and sturdy controls including the electronic circuitry (if any), the fluid-operated components, and the sensor(s).

An advantage of positioning a fresh bobbin 18 (such as the left-hand bobbin of FIG. 5) at a location very close to the turntable 2 is that, if and when necessary, a fresh bobbin can be transferred onto the shaft 10*a* or 10*b* with very little loss in time. The situation is even more satisfactory if the controls for the elevator 30 are set up with a view to ensure that the elevator normally comes to a halt at a level beneath the fresh bobbin which is nearest to the turntable 2. This, too, is shown in FIG. 5.

The mounting of the shafts 10*a*, 10*b* on the turntable 2 in such a way that their axes are parallel to the axis 4 of the turntable also contributes to simplicity, compactness and reliability of the apparatus 1. Thus, this is one of the reasons that the elevator 30 is merely required to perform short upward and downward movements but mainly a linear movement in parallelism with the axes of the turntable and the shafts 10*a*, 10*b*.

Another important advantage of the improved apparatus 1 is that its bobbins are not subjected to prononced stresses so that they can employ simple, compact and inexpensive (such as throw-away) cores 56. Moreover, a throw-away core can be readily affixed to the shaft 10*a* or 10*b* by resorting to adhesive-coated strips and/or to simple clamps which can even deform a throw-away core 56 during retention against axial movement on the shaft 10*a* or 10*b* toward or away from the adjacent surface of the turntable 2. For example, each of the shafts 10*a*, 10*b* can be provided with projections which are retractible into or movable radially outwadly beyond the peripheral surfaces of the shafts 10*a*, 10*b* to thus possibly deform but to reliably hold the core 56 of a bobbin 18 or 14 in requisite axial and/or angular position relative to the shaft.

Each core 56 can be readily designed in such a way that its radially innermost portion can be deformed by the aforediscussed projections of the shaft 10*a* or 10*b* but that such deformation does not affect the condition of the supply 22 of convoluted web material 16 which is to be fed to a consuming machine.

The advantages of the sensor 42 or equivalent monitoring means will be readily appreciated upon perusal of the preceding parts of this specification. Thus, the sensor 42 reliably prevents collision between neighboring fresh bobbins 18 on the guide members 26 and other fresh bobbins (such as the bobbin 18 above the elevator 30 and the bobbin A shown in FIG. 8). Furthermore, such sensor renders it possible to readily position neighboring fresh bobbins on the guide members 26 at a desired or required distance from each other. Still further, the sensor 42 or an equivalent sensor can reliably arrest the elevator 30 in an optimum position for most satisfactory engagement with a fresh bobbin 18 which is to be lifted above the guide members 26 preparatory to advancement of such fresh bobbin in the axial direction of the turntable 2.

Several of the just enumerated advantages of the sensor 42 are achieved due to the fact that the sensor is mounted on the elevator 30 and/or to the fact that the elevator 30 is provided with a single sensor 42. It is presently preferred to employ a photosensitive detector. If the sensor 42 is mounted at that side of the elevator 30 which confronts the turntable 2 (this is actually shown in the drawings), it is presently preferred to move the elevator 30 away from the turntable 2 until the radiation issuing from a photosensitive sensor or detector 42 is no longer obstructed by the fresh bobbin 18 which is located to the left of the elevator as viewed in FIGS. 2 to 13.

An important advantage of the arrangement 50 is that it can remove and gather empty cores (expired bobbins) 56 in a simple and time-saving manner. Though the arrangement 50 can be put to use in certain conventional bobbin manipulating apparatus, it is particularly advantageous to employ it in combination with the apparatus 1 or an equivalent bobbin manipulating apparatus. The gripper 58 not only serves to transfer cores 56 from the shaft 10*a* or 10*b* into the trough 54 of the arrangement 50 but can further serve to move one or more (e.g., an entire row of) cores 56 within the trough 54. The utilization of a trough 54 which is designed to accept and to temporarily confine one, two or an entire row of coaxial cores 56 also contributes to the simplicity, compactness and lower cost of the arrangement 50 and hence of the novel combination of constituents including the arrangement 50 and the apparatus 1. Additional savings in space are achieved in that the trough 54 is installed next to the guide members 26 and is parallel or at least substantially parallel thereto. If desired or necessary, one or more spare troughs 54 can be installed in the lower right-hand portion of the apparatus (as viewed in FIG. 1).

Figure 14:
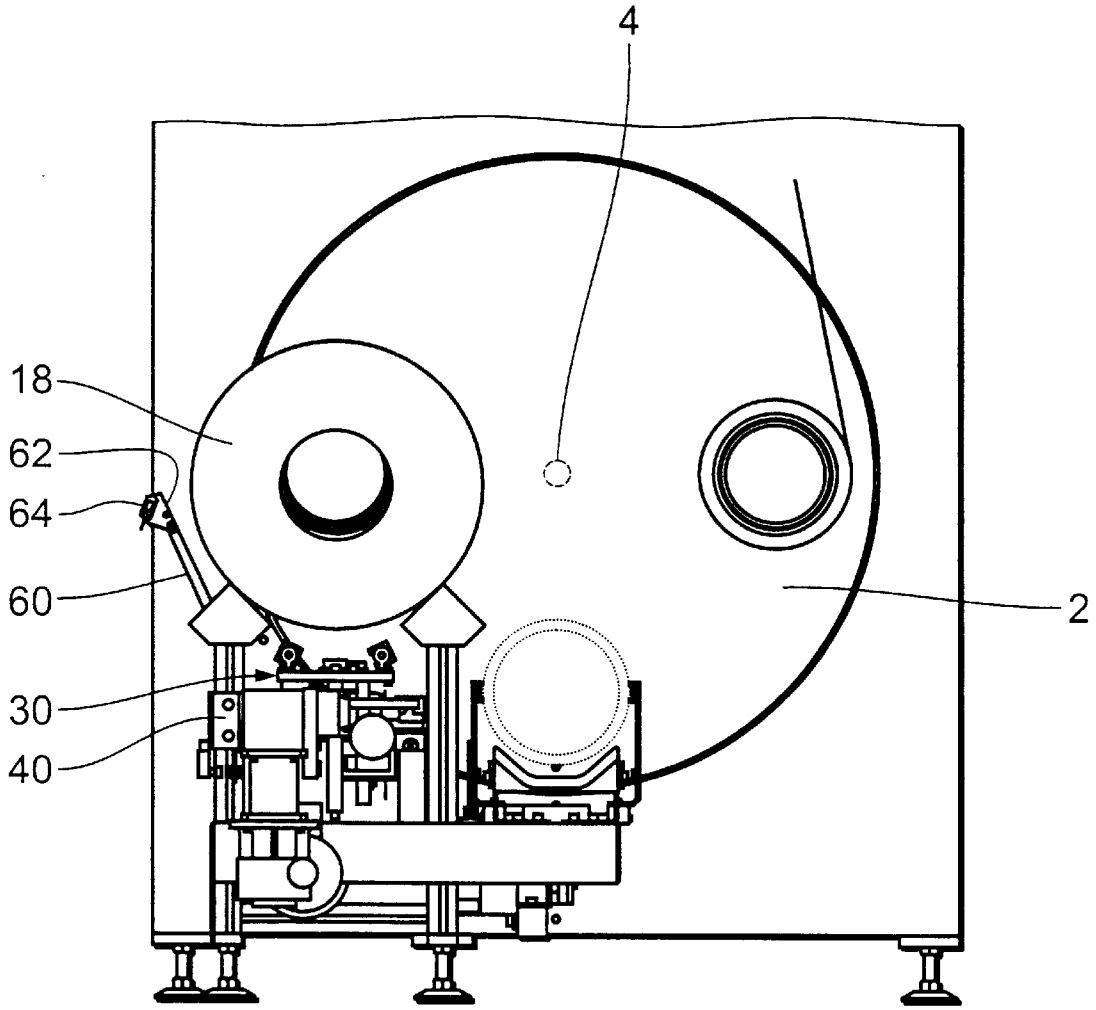
FIG. 14 is a front elevational view of an apparatus constituting a modification of the apparatus which is shown in FIGS. 1 to 13.
Figure 15:
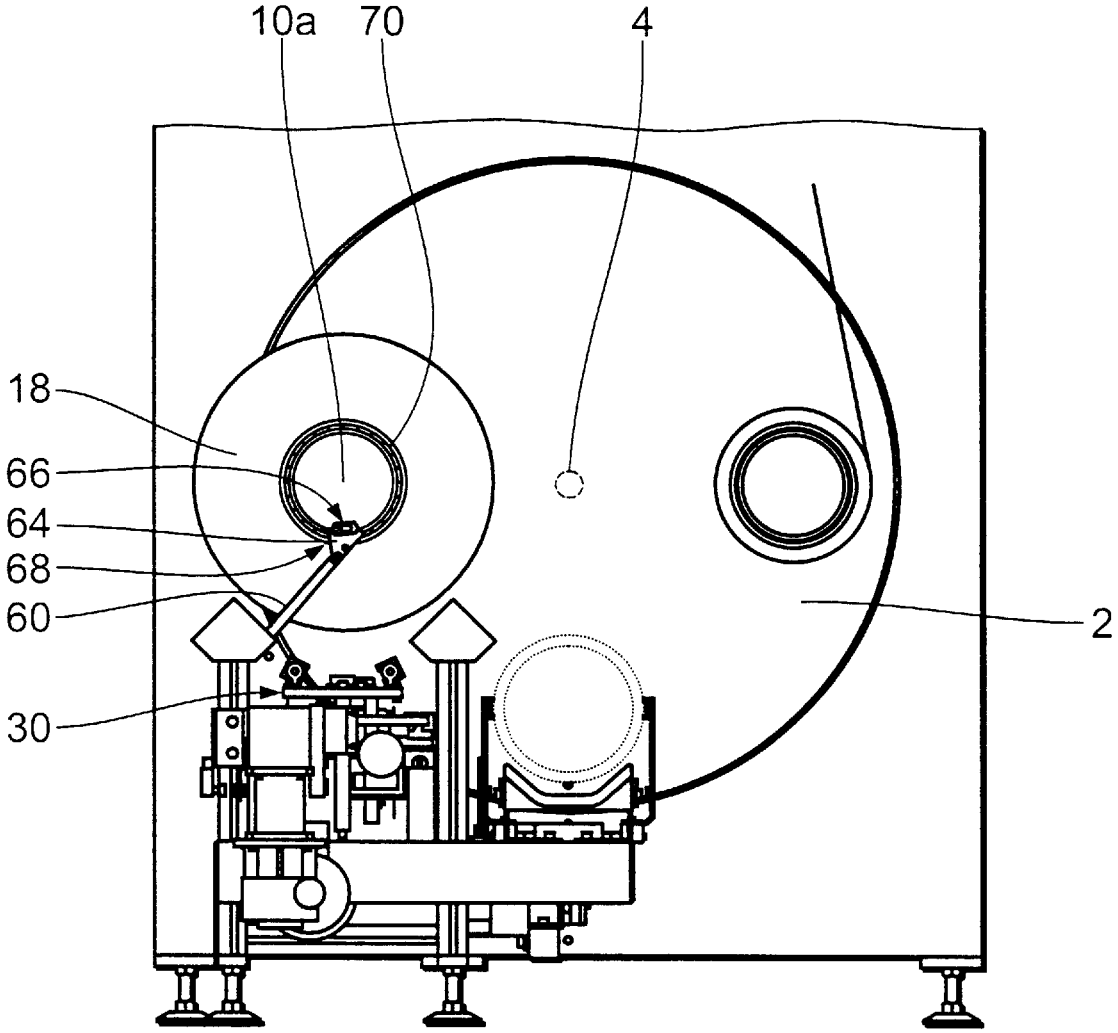
FIG. 15 is a view similar to that shown in FIG. 14 but with a sensor moved to a different position relative to a fresh bobbin on the adjacent support of the mobile carrier for expiring bobbins.
Figure 16:
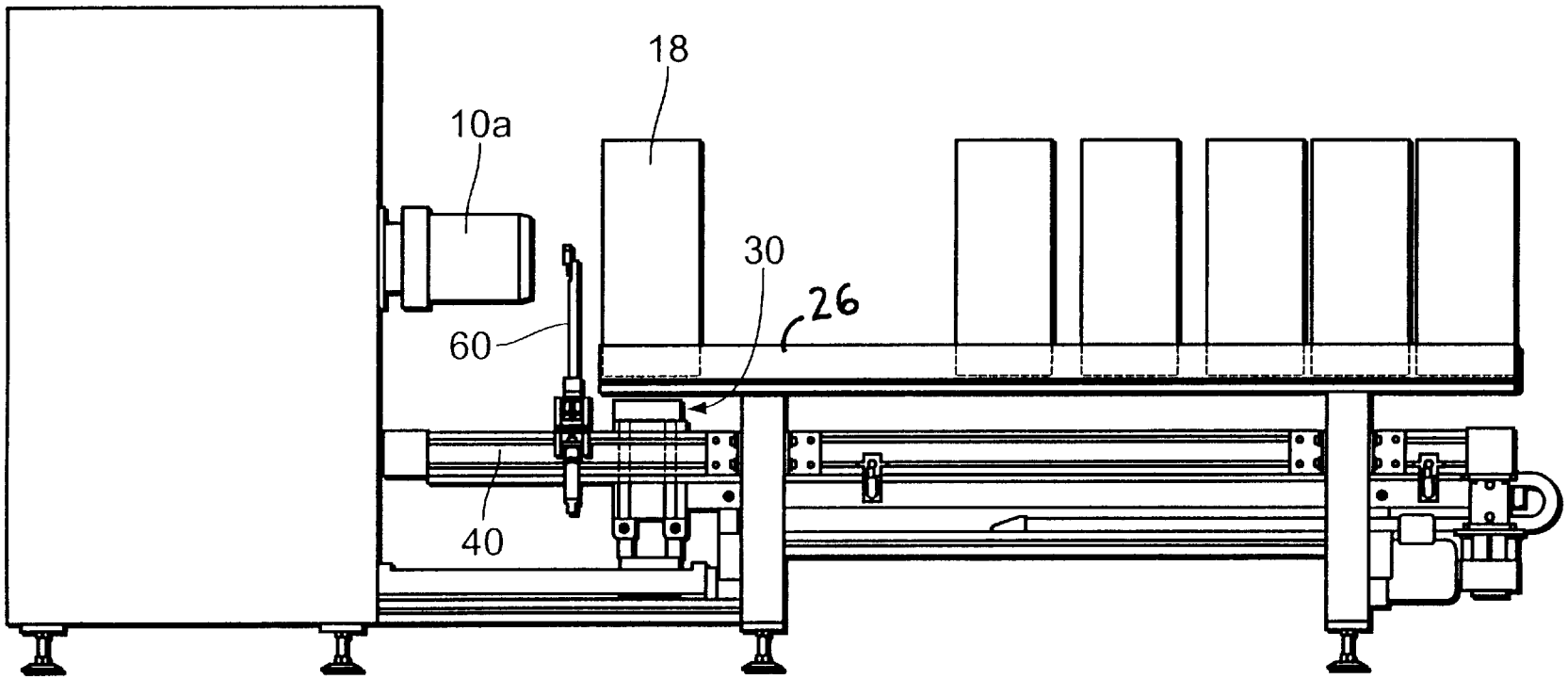
FIG. 16 is a side elevational view of the a modified apparatus which is shown in FIGS. 14 and 15.

FIGS. 14 to 16 illustrate certain details of a modified apparatus. All such parts which are identical or plainly analogous to those already described with reference to the apparatus 1 of FIGS. 1 to 13 are denoted by similar characters. The modified apparatus of FIGS. 14 to 16 employs a gripper or lever 60 which is mounted on the linear guide 40 so that it can be pivoted between the positions shown in FIGS. 14 and 15. FIG. 16 shows that this lever is installed between the shafts 10*a*, 10*b* and the adjacent ends of the guide members 26. The lever 60 is pivotable about an axis which is parallel to that of the shaft 4 for the turntable 2.

The lever 60 is idle when it assumes the angular position of FIG. 14, namely it does not interfere with the advancement of a fresh bobbin 18 from the reservoir including the guide members 26 onto the shaft 10*a* or 10*b*, whichever is then maintained at the nine o'clock position of the turntable 2 as viewed in FIG. 14.

Once a fresh bobbin 18 has been advanced from the predetermined (leftmost) position of FIG. 6 onto the aligned stub shaft 10*a* or 10*b* (namely onto the shaft 10*a* as viewed in FIG. 15), the lever 15 is pivoted from the inoperative position of FIG. 14 to the operative position of FIG. 5 so that it holds the bobbin 18 against axial movement away from the turntable 2 and off the shaft 10*a*. The dimensions of the parts in the apparatus of FIGS. 14 to 16 are selected in such a way that the lever 60 must be pivoted through approximately 80° in order to move from the inoperative or retracted position of FIG. 14 to the operative position of FIG. 15, or vice versa.

The apparatus of FIGS. 14 to 16 further comprises a suitable sensor 64 which is shown as being mounted at the free end 62 of the lever. This sensor is located at the level of the lowermost portion 66 of the shaft 10*a* or 10*b*, whichever is located at the nine o'clock position of the turntable 2 shown in FIG. 14 or 15. A bobbin 18 and the elevator 30 are located at their predetermined positions of FIG. 16. The sensor 64 monitors the bobbin 18 on the elevator and transmits a signal when it detects the lowermost portion 68 of the central opening 70 in the core of such bobbin. The elevator 30 then descends and the lever 60 is then pivoted back to the position of FIG. 14. This. enables the elevator 30 to again move the bobbin 18 to the level of the shaft 10*a* or 10*b*.

U.S. Pat. No. 3,974,007 (granted Aug. 10, 1976 to Greve for "METHOD AND APPARATUS FOR THE PRODUCTION OF FILTER ROD SECTIONS OR THE LIKE") dicloses a filter rod making machine which can utilize an apparatus (1) and an expired bobbin manipulating arrangement (50) embodying the present invention. The fresh bobbins 18 then contain supplies 22 of convoluted cigarette paper (16) which is fed to a mechanism serving to drape a continuous web of cigarette paper or any other suitable strip-shaped wrapping material around a continuous rod-like filler of fibrous filter material for tobacco smoke.

U.S. Pat. No. 4,281,670 (granted Aug. 4, 1981 to Heitmann et al. for "APPARATUS FOR INCREASING THE PERMEABILITY OF WRAPPING MATERIAL FOR ROD-SHAPED SMOKERS' PRODUCTS") discloses a cigarette rod making machine which can employ the apparatus 1 and the arrangement 50 of the present invention to supply a continuous web of cigarette paper to a wrapping mechanism wherein the web is draped around a continuous rod-like filler of tobacco and/or other smokable material so that the filler and the web form a continuous cigarette rod which is ready to be subdivided into plain cigarettes of unit length or multiple unit length.

The '670 patent to Heitmann et al. further discloses a filter tipping machine wherein bobbins of convoluted web material are utilized to supply so-called tipping paper one side of which is coated with adhesive paste and the leding end of which is severed at regular intervals to yield a series of so-called uniting bands. The uniting bands are draped around filter mouthpieces and portions of plain cigarettes of unit length or multiple unit length. The thus united products constitute filter cigarettes of unit length or multiple unit length. Filter cigarettes of unit length are ready for packing, e.g., in the aforediscussed machine known as COMPAS 500. Filter cigarettes of multiple unit length must be subdivided (to yield filter cigarettes of unit length) prior to packing.

It is further clear that the improved apparatus 1 and/or the improved arrangement 50 can be utilized, with equal or similar advantage, in numerous machines and/or production lines wherein webs of paper, metallic foil, plastic foil, and/or other webs or strips of flexible material are to be fed to various web consuming and/or processing machines, e.g., for the making and the application of labels, wrapping materials other than those used in cigarette packing machines and/or many others.

All U.S. and/or foreign patents, Utility Models, patent applications and/or other publications adequately disclosing machines, production lines, apparatus and/or other structures which can be utilized in conjunction with and/or which can embody and/or which can be otherwise usefully combined or associated with the aforedescribed novel apparatus and/or novel arrangement are to be considered as having been incorporated herein by reference. This also includes the commonly owned parent German patent application Serial No. 198 47 160.2 filed Oct. 13, 1998.

The method of the present invention can be practiced to supply a series of successive fresh rotary bobbins, each of which contains a supply of convoluted flexible web material (such as paper, metallic foil, plastic foil and/or the like) to an unwinding location (e.g., in a packing, other wrapping, filter tipping, cigarette rod making, filter rod making or other machine or production line) where the bobbins are rotated about a predetermined axis to pay out (i.e., dispense) the convoluted web material.

In accordance with a presently preferred embodiment, the method comprises the steps of establishing for fresh bobbins a station arranged to accommodate a variable number of fresh bobbins, and conveying individual bobbins in parallelism with and transversely of the predetermined axis.

In accordance with a feature of the invention, the conveying step involves (or can involve) moving the bobbins only in parallelism with and transversely of the predetermined axis.

The predetermined axis is, or can be, an at least substantially horizontal axis, and the step of moving the bobbins in parallelism with and transversely of the predetermined axis then preferably includes moving the bobbins horizontally and vertically.

The method can further comprise the step of temporarily arresting at least some of the fresh bobbins together constituting the aforementioned series of bobbins at a predetermined distance from the unwinding location.

The method can also comprise the step of maintaining the fresh bobbins at the aforementioned station in positions in which the bobbins are coaxial with each other.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of apparatus for loading and unloading bobbins and, therefore, such adaptations should and are intended to be comprehended within the meaning and range of equivalence of the appended claims.

What is claimed is:

1. Apparatus for replacing expired rotary bobbins with fresh rotary bobbins containing supplies of convoluted web material, comprising:

a mobile carrier for expiring bobbins;

a reservoir for temporary storage of fresh bobbins; and means for conveying fresh bobbins from said reservoir directly to said carrier, wherein said reservoir comprises at least one elongated guide for fresh bobbins, said conveying means comprising means for lifting a first bobbin off any one of a plurality of first selected portions of said at least one guide and for depositing a bobbin on any one of a plurality of second selected portions of said at least one guide.

2. The apparatus of claim 1, wherein said mobile carrier comprises a turntable indexible about a predetermined axis and having at least one support for a core of a bobbin, the apparatus further comprising apparatus adapted to index the turntable about the predetermined axis.

3. The apparatus of claim 2, wherein said conveying means comprises an elevator, means for moving said elevator between a plurality of levels with respect to said carrier, and means for advancing said elevator toward and away from said carrier.

4. The apparatus of claim 2, wherein said reservoir comprises means for storing a plurality of coaxial bobbins.

5. The apparatus of claim 4, wherein said support defines an axis which is at least substantially parallel to the common axis of bobbins in said storing means.

6. The apparatus of claim 4, wherein said means for storing comprises at least one elongated guide for coaxial bobbins, said guide being at least substantially parallel with said support.

7. The apparatus of claim 6, wherein said at least one guide is substantially horizontal.

8. The apparatus of claim 4, wherein said storing means comprises two parallel guide members for outermost convolutions of convoluted web material on the coaxial bobbins, said conveying means comprising an elevator movable up and down between said guide members to lift selected fresh bobbins off said guide members.

9. The apparatus of claim 8, wherein said mobile carrier comprises a turntable indexible about an axis which is parallel to said guide members, said conveying means further comprising means for transporting said elevator at a level above and in parallel with said guide members toward and away from said turntable.

10. The apparatus of claim 8, wherein said elevator is transportable to deliver a fresh bobbin from said reservoir directly onto a support of said carrier.

11. The apparatus of claim 2, wherein said carrier comprises a turntable indexible about a predetermined axis and having at least one support for a core of a bobbin, said at least one support including an eccentric shaft on said turntable and further comprising means for releasably clamping a core of a fresh bobbin on said eccentric shaft.

12. The apparatus of claim 11, wherein said clamping means comprises means for holding the core of a bobbin against movement axially of said at least one shaft and away from said turntable.

13. The apparatus of claim 1, wherein said second selected portions include a portion in which a fresh bobbin is maintained in a position of readiness for transfer directly onto said carrier.

14. The apparatus of claim 13, wherein said position of readiness is a position of said second plurality nearest to said carrier.

15. Apparatus for replacing expired rotary bobbins with fresh rotary bobbins containing supplies of convoluted web material, comprising:

a mobile carrier for expiring bobbins;

a reservoir for temporary storage of fresh bobbins;

means for conveying fresh bobbins from said reservoir directly to said carrier; and signal generating means for monitoring the positions of fresh bobbins in said reservoir, said monitoring means being arranged to move with said conveying means.

16. The apparatus of claim 15, wherein said signal generating means includes means for arresting said conveying means in response to detection of a fresh bobbin in said reservoir.

17. The apparatus of claim 15, wherein said conveying means includes means for delivering to said carrier successive fresh bobbins of a plurality of fresh bobbins in said reservoir.

18. The apparatus of claim 17, wherein said means for delivering is arranged to deliver successive fresh bobbins to a predetermined position in said reservoir and, in the event of occupancy of said predetermined position, to a position immediately adjacent the predetermined position.

19. The apparatus of claim 18, wherein said means for delivering is arranged to deliver, in the event of occupancy of said predetermined position and said position immediately adjacent said predetermined position, successive filled bobbins in a predetermined sequence next to said immediately adjacent position.

20. Apparatus for replacing expired rotary bobbins with fresh rotary bobbins containing supplies of convoluted web material, comprising:

a mobile carrier for expiring bobbins;

a reservoir for temporary storage of fresh bobbins;

means for conveying fresh bobbins from said reservoir directly to said carrier;

wherein said means for transferring comprises means for mechanically gripping cores during transfer from said carrier to said magazine.

21. Apparatus for replacing expired rotary bobbins with fresh rotary bobbins containing supplies of convoluted web material, comprising:

a mobile carrier for expiring bobbins;

a reservoir for temporary storage of fresh bobbins; and means for conveying fresh bobbins from said reservoir directly to said carrier, wherein said magazine comprises an elongated trough arranged to confine expired bobbins in positions in which the expired bobbins are coaxial with each other, said transferring means comprising means for moving expired bobbins in the trough by way of the expired bobbin being transferred from said carrier into said trough.

22. The apparatus of claim 21, further comprising signal generating means for monitoring the positions of said mobile carrier, said monitoring means being adjacent said reservoir and said conveying means.

23. An arrangement for manipulating hollow rotary cores of expired bobbins in an apparatus for replacing expired bobbins with fresh bobbins carrying convoluted web material, comprising:

at least one magazine for cores, said magazine comprising an elongated trough arranged to confine cores and in which the cores are coaxial with each other; and means for transferring cores from a bobbin carrier of the replacing apparatus to said magazine, said transferring means comprising means for moving the cores in the trough axially by way of the core being transferred from said bobbin carrier into said trough.

* * * * *